US007509966B2

(12) United States Patent
Karasin et al.

(10) Patent No.: US 7,509,966 B2
(45) Date of Patent: Mar. 31, 2009

(54) STEP-UP DEVICE

(75) Inventors: Craig Karasin, Moorestown, NJ (US); Robert Popek, Doylestown, PA (US); David Reed, Langhorne, PA (US); Andrew Vellrath, New Castle, DE (US); Thomas J. Powers, Fairless Hills, PA (US)

(73) Assignee: Full Life Products, LLC, Moorestown, NJ (US)

( * ) Notice: Subject to any disclaimer, the term of this patent is extended or adjusted under 35 U.S.C. 154(b) by 271 days.

(21) Appl. No.: 11/257,807

(22) Filed: Oct. 25, 2005

(65) Prior Publication Data

US 2006/0181093 A1 Aug. 17, 2006

Related U.S. Application Data

(60) Provisional application No. 60/621,708, filed on Oct. 25, 2004, provisional application No. 60/621,754, filed on Oct. 25, 2004.

(51) Int. Cl.
*A45B 1/00* (2006.01)

(52) U.S. Cl. ..... 135/66

(58) Field of Classification Search ..... 135/65, 135/66, 70, 74, 84
See application file for complete search history.

(56) References Cited

U.S. PATENT DOCUMENTS

| | | | |
|---|---|---|---|
| 1,307,058 | A | 6/1919 | McGrath |
| 2,244,869 | A | 6/1941 | Everest et al. |
| D187,450 | S | 3/1960 | Maxwell |
| 3,133,551 | A | 5/1964 | Murcott |
| 3,157,187 | A | 11/1964 | Murcott |
| 3,165,314 | A | 1/1965 | Clearman et al. |
| 3,273,575 | A | 9/1966 | Aldrich |
| 3,350,095 | A | 10/1967 | Clasen |
| D229,728 | S | 12/1973 | Thomas |
| D230,531 | S | 2/1974 | Thomas |
| 3,884,327 | A | 5/1975 | Zigman |
| 4,044,784 | A | 8/1977 | Smith |
| 4,046,374 | A | 9/1977 | Breyley |
| 4,062,372 | A | 12/1977 | Slusher |
| 4,091,828 | A | 5/1978 | Jorgensen |
| 4,106,521 | A | 8/1978 | Thomas |
| 4,135,535 | A | 1/1979 | Thomas |
| 4,258,735 | A | 3/1981 | Meade |
| 4,274,430 | A | 6/1981 | Schaaf et al. |

(Continued)

FOREIGN PATENT DOCUMENTS

| | | | |
|---|---|---|---|
| GB | 2057896 | A | 4/1981 |

(Continued)

OTHER PUBLICATIONS

U.S. Appl. No. 11/107,198, filed Apr. 15, 2005, Tartaglia.

(Continued)

*Primary Examiner*—David Dunn
*Assistant Examiner*—Noah Chandler Hawk
(74) *Attorney, Agent, or Firm*—Morgan Lewis & Bockius LLP

(57) ABSTRACT

A step-up assist device having a base with an extendable and retractable platform, an actuator operably engaged with linkage connected to the platform, the linkage configured to extend and retract the platform upon operation of the actuator.

19 Claims, 44 Drawing Sheets

U.S. PATENT DOCUMENTS 4,341,381 A 7/1982 Norberg
4,342,465 A 8/1982 Stillings
4,378,862 A 4/1983 Carmel
D272,677 S 2/1984 Bove et al.
4,550,802 A 11/1985 Roper
4,559,962 A 12/1985 Marchiano
4,561,652 A 12/1985 Wilkinson
4,601,302 A 7/1986 Breen et al.
D290,186 S 6/1987 Meunchen
D295,694 S 5/1988 Mace
4,787,405 A 11/1988 Karwoski
4,796,648 A 1/1989 Goulter
4,834,127 A 5/1989 Van Sice
4,844,199 A 7/1989 Nimz
4,884,587 A 12/1989 Mungons
4,962,781 A 10/1990 Kanbar
4,974,871 A 12/1990 Mao
4,993,446 A 2/1991 Yarbrough
4,997,001 A 3/1991 DiCarlo
5,056,545 A 10/1991 Spaeth
5,090,434 A 2/1992 Hagen
D324,946 S 3/1992 Karten
5,112,044 A 5/1992 Dubats
5,127,664 A 7/1992 Cheng
5,131,494 A 7/1992 Heifetz
D329,538 S 9/1992 Rau
5,156,176 A 10/1992 Doorenbos
5,188,138 A 2/1993 Yamasaki et al.
5,201,334 A 4/1993 Tseng
5,238,013 A 8/1993 Battiston et al.
5,282,486 A 2/1994 Hoover
5,301,704 A 4/1994 Brown
5,307,828 A 5/1994 Gardner et al.
5,318,057 A * 6/1994 Wallum ..... 135/65
5,339,850 A 8/1994 Mertz
5,355,904 A 10/1994 Wallum
5,385,163 A 1/1995 Fairchild
5,390,687 A 2/1995 Tsai
5,392,800 A 2/1995 Sergi
5,392,801 A 2/1995 Hannoosh et al.
5,433,234 A 7/1995 Lapere
5,449,221 A 9/1995 Stander
5,482,070 A 1/1996 Kelly
5,495,867 A 3/1996 Block
5,499,645 A 3/1996 Baliga
5,588,457 A 12/1996 Tartaglia
5,636,651 A 6/1997 Einbinder
5,692,533 A 12/1997 Meltzer
5,746,288 A 5/1998 O'Neal et al.
5,785,070 A 7/1998 Block et al.
5,794,638 A 8/1998 Richey et al.
D401,192 S 11/1998 Gagnon
D411,343 S 6/1999 Brightbill et al.
D411,653 S 6/1999 Richey et al.
5,941,262 A 8/1999 Tschirhart
5,954,074 A 9/1999 Mattson
5,983,912 A 11/1999 Leu
6,003,532 A 12/1999 Pi
D422,747 S 4/2000 Evans
D428,367 S 7/2000 Lundh
6,158,453 A 12/2000 Nasco
D439,625 S 3/2001 Tamaribuchi
D441,162 S 4/2001 Grove et al.
6,217,056 B1 4/2001 Tsuchie
D444,605 S 7/2001 Porter
D448,151 S 9/2001 Outlaw
6,318,392 B1 11/2001 Chen
6,338,355 B1 1/2002 Cheng
D455,985 S 4/2002 Olivares
D457,840 S 5/2002 Hsia
6,454,357 B1 9/2002 Foulger
6,494,469 B1 12/2002 Hara et al.
D468,669 S 1/2003 Hopely, Jr.
D480,995 S 10/2003 Owens
6,675,820 B2 1/2004 Balan
6,708,705 B2 3/2004 Nasco, Sr.
6,715,794 B2 4/2004 Frank
D494,109 S 8/2004 Karasin et al.
6,877,519 B2 4/2005 Fink
D506,419 S 6/2005 Coster
7,261,113 B2 * 8/2007 Tartaglia ..... 135/66
2001/0038186 A1 11/2001 Wychozowycz
2003/0094191 A1 5/2003 Lin
2003/0111100 A1 6/2003 Bell et al.
2003/0205265 A1 11/2003 Nasco, Sr.
2004/0216776 A1 11/2004 Otis
2005/0093326 A1 5/2005 Miller et al.

FOREIGN PATENT DOCUMENTS

JP 8089322 4/1996
JP 10071181 3/1998
JP 2004357731 12/2004

OTHER PUBLICATIONS

U.S. Appl. No. 11/107,260, filed Apr. 15, 2005, Tartaglia.
U.S. Appl. No. 29/215,836, filed Oct. 25, 2004, Karasin et al.
U.S. Appl. No. 29/215,837, filed Oct. 25, 2004, Vellrath.
U.S. Appl. No. 29/215,839, filed Oct. 25, 2004, Vellrath.
U.S. Appl. No. 29/215,880, filed Oct. 25, 2004, Karasin et al.
U.S. Appl. No. 29/215,881, filed Oct. 25, 2004, Karasin et al.
U.S. Appl. No. 29/215,882, filed Oct. 25, 2004, Vellrath.
U.S. Appl. No. 29/215,883, filed Oct. 25, 2004, Reed et al.
U.S. Appl. No. 29/215,899, filed Oct. 25, 2004, Karasin et al.
U.S. Appl. No. 29/215,901, filed Oct. 25, 2004, Vellrath.
U.S. Appl. No. 29/215,902, filed Oct. 25, 2004, Reed et al.
U.S. Appl. No. 11/257,699, filed Oct. 25, 2005, Karasin et al.
Declaration of John Tartaglia executed May 4, 2005.

* cited by examiner

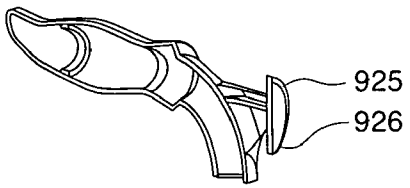
FIG. 9B-1
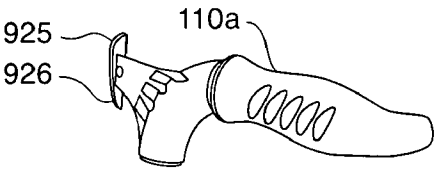
FIG. 9B-2
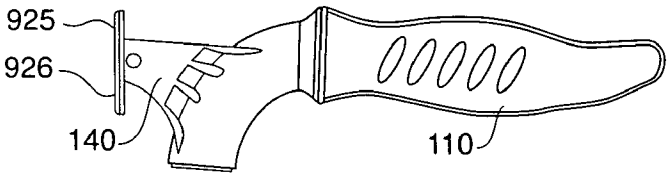
FIG. 9B-3
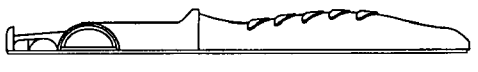
FIG. 9B-4
FIG. 9B-5
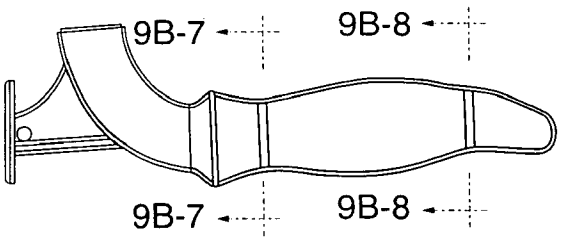
FIG. 9B-6
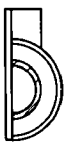
FIG. 9B-7
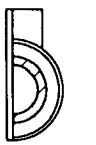
FIG. 9B-8

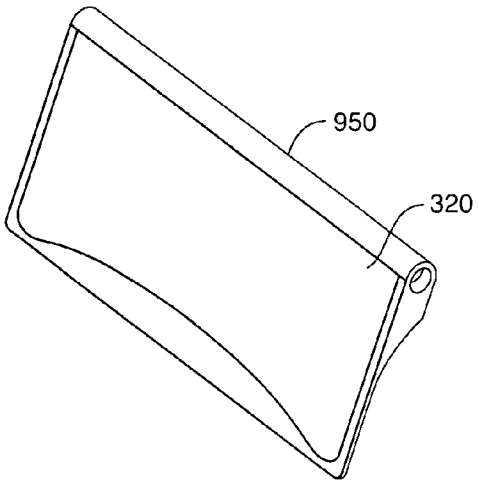
FIG. 9E-1
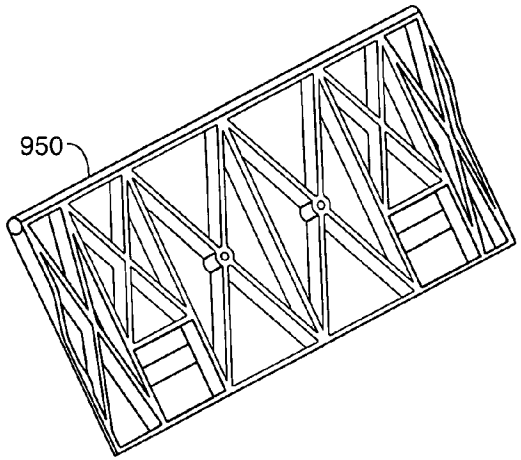
FIG. 9E-2
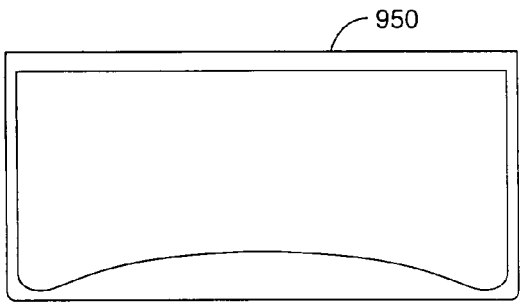
FIG. 9E-3
FIG. 9E-4
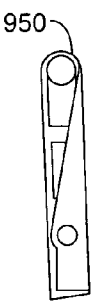
FIG. 9E-5
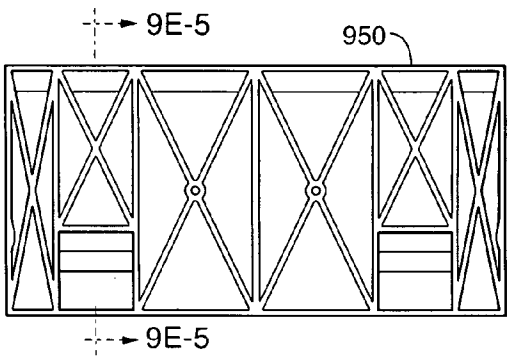
FIG. 9E-6

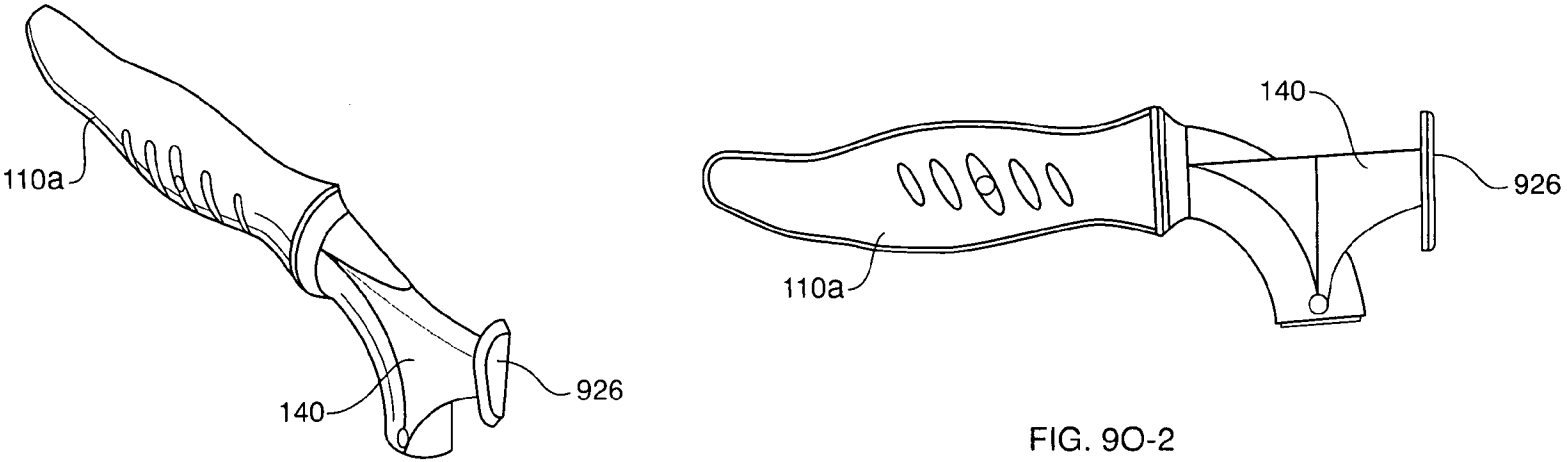
FIG. 9O-1
FIG. 9O-2
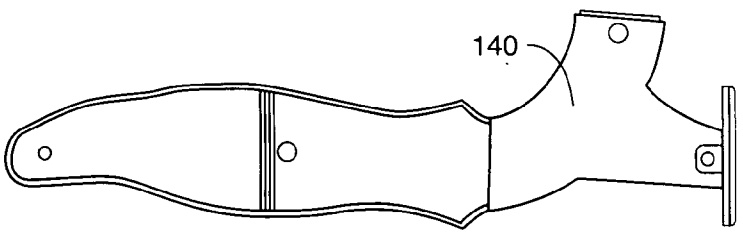
FIG. 9O-3
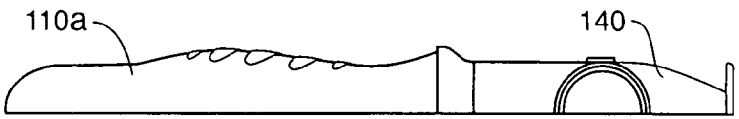
FIG. 9O-4

STEP-UP DEVICE

RELATED APPLICATIONS

This application claims priority to U.S. Provisional Patent Application 60/621,708 and U.S. Provisional Patent Application 60/621,754 both of which were filed Oct. 25, 2004 and which are hereby incorporated by reference in their entirety.

INCORPORATION BY REFERENCE

All references cited herein are hereby incorporated by reference as if set forth in their entirety herewith. Also incorporated by reference in its entirety is U.S. patent application entitled of Karasin et al. entitled ROLLING/BRAKING CANE filed on even date herewith.

SUMMARY OF PREFERRED EMBODIMENTS

In one embodiment there is a step-up assist device that includes a base having an extendable and retractable platform; an actuator including linkage connected to the platform and the actuator, the linkage configured to extend and retract the platform upon operation of the actuator. In one embodiment of the step-up assist device, the actuator has a first position corresponding to an extended configuration of the platform and a second position corresponding to a retracted position of the platform. In a further embodiment of the step-up device, there is an upright connected substantially normal to the base. In one embodiment of the step-up device the actuator is connected to the base proximate a connection from the upright to the base. In a further embodiment of the step-up device the platform has a first planar surface and a movable second planar surface that pivots between substantially coplanar with the first planar surface to substantially perpendicular to the first planar surface. In a still further embodiment of the step-up device, the first position of the actuator corresponds to the second planar surface being substantially coplanar with the first planar horizontal surface and the second position of the actuator corresponds to the second planar surface being substantially perpendicular to the first planar surface. In one embodiment of the step-up device, substantially all of the linkage is disposed within the base. In a further embodiment of the step-up device, the linkage includes cable linkage. In another embodiment, the linkage includes rigid linkage. In a still further embodiment, the rigid linkage of the step-up device includes stamped sheet metal. In one embodiment, the step-up device also includes at least one leg linked to both the actuator and the extendible platform wherein the at least one leg supports at least a portion of the platform in an extended position. In a further embodiment of the step-up device, the linkage includes a rocker arm having a first face, a second face, a pivot point between the first face and second face and a moment arm connector extended a fixed distance from the pivot point. In a still further embodiment, the moment arm connector of the step-up device pivots about the pivot point during operation of the actuator. In one embodiment, the linkage includes a drive link with an axle portion and an elbow arm radially disposed about the axle portion; a linkage member having a substantially constant tension and a first securement engaged with the moment arm connector and a second securement engaged to the axle portion of the drive link wherein a pivot of the moment arm connector about the pivot point induces the axle portion to rotate and the elbow arm to rotate about the axle arm. In one embodiment of the step-up device, at least one leg is rotatably connected to the elbow arm and to the second surface wherein the rotation of the elbow arm induces the second surface to pivot to a substantially locked position and the leg to support the second surface. In one embodiment of the step-up device, the base is configured to be stepped upon when the base is in a retracted position and when the base is in an extended position. In one embodiment, the actuator includes a foot pedal. In one embodiment, step-up device includes a shaft with a first end connected to the base and a second end configured to accommodate a user's hand wherein the actuator is configured to be operated by the user's hand.

In one embodiment, there is a step-up device that includes a base means for supporting a user in an extended position and for supporting a user in a retracted position; and an actuator attached to the base for toggling between the extended position and the retracted position. In one embodiment, the step-up device also includes an upright member attached to the base.

BRIEF DESCRIPTION OF THE DRAWINGS

Reference is made to the accompanying drawings in which are shown illustrative embodiments of the invention, from which its novel features and advantages will be apparent.

In the drawings:

FIG. 5 depicts a cutaway view of a base of a step-up device according to the present invention.

FIG. 6B-1 to 6B-3 illustrates a drive link of the present invention.

FIG. 6D-1 to 6D-5 illustrates a bias clip of the present invention.

Figures 3, 4A:
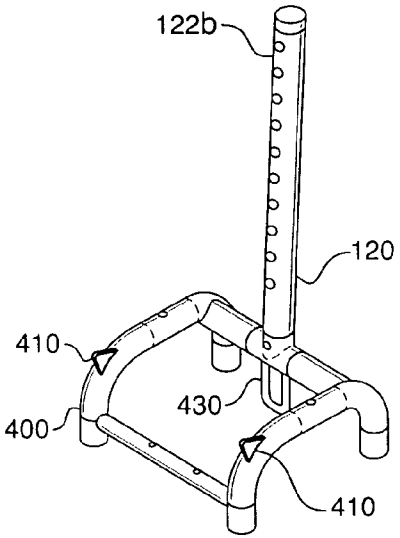
Figures 2, 4A:
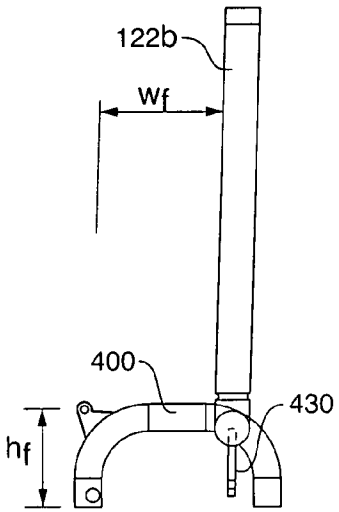
FIG. 4A-1 to 4A-5 depicts a frame base of a step-up device according to the present invention.
Figures 1, 4A:
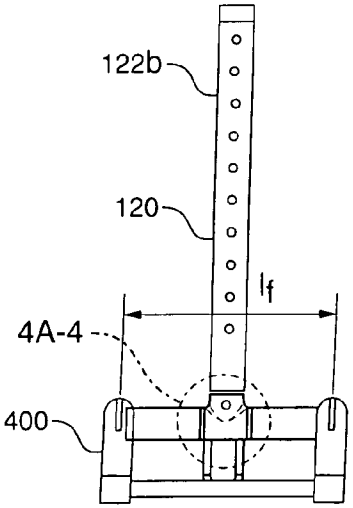
Figures 4, 4A, 5:
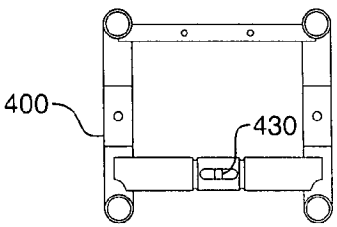
Figures 4, 4A:
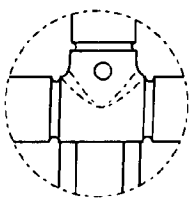
Figure 4B:
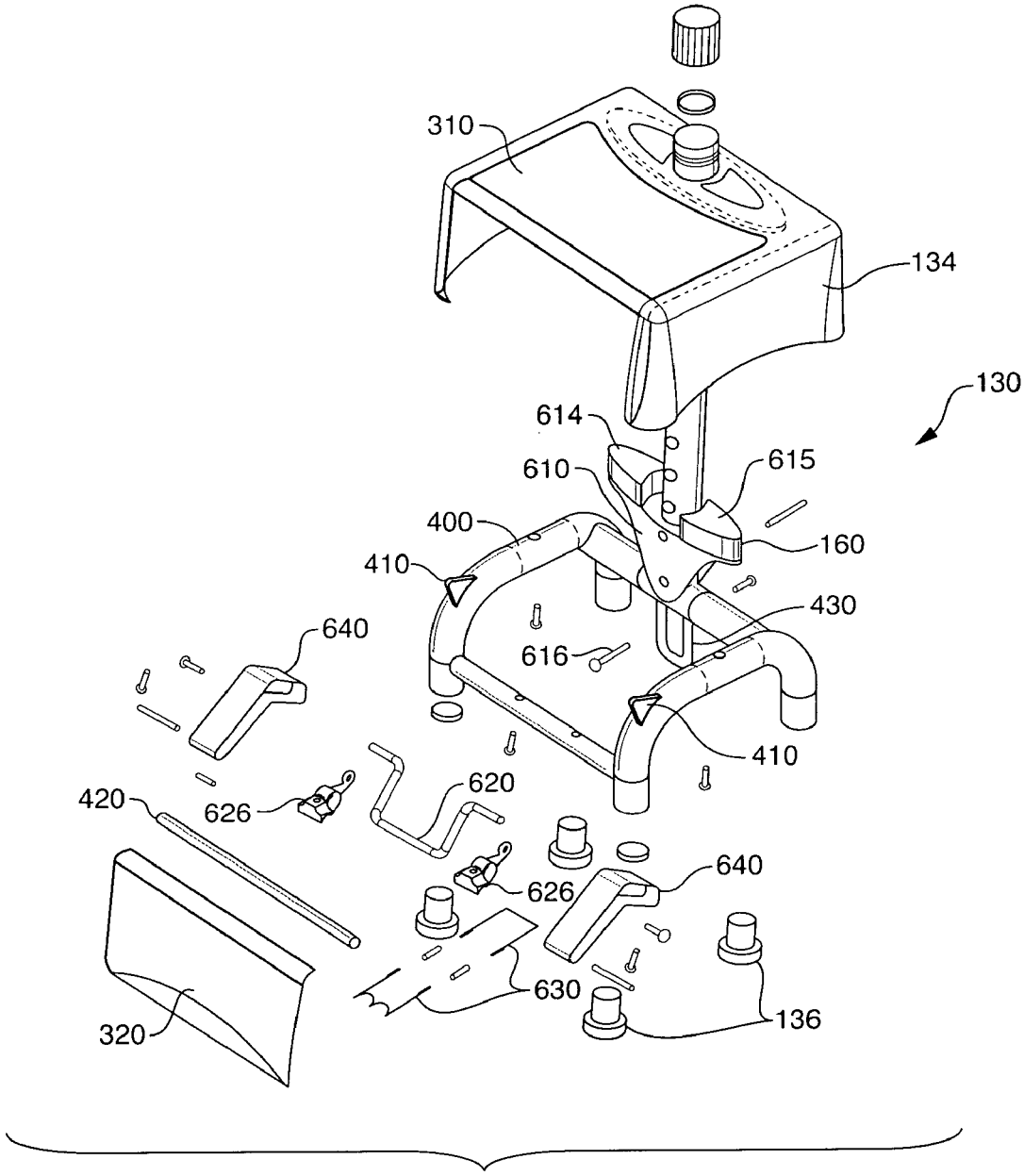
FIG. 4B depicts a disassembled base and actuator assembly of a step-up device according to the present invention.
Figure 5:
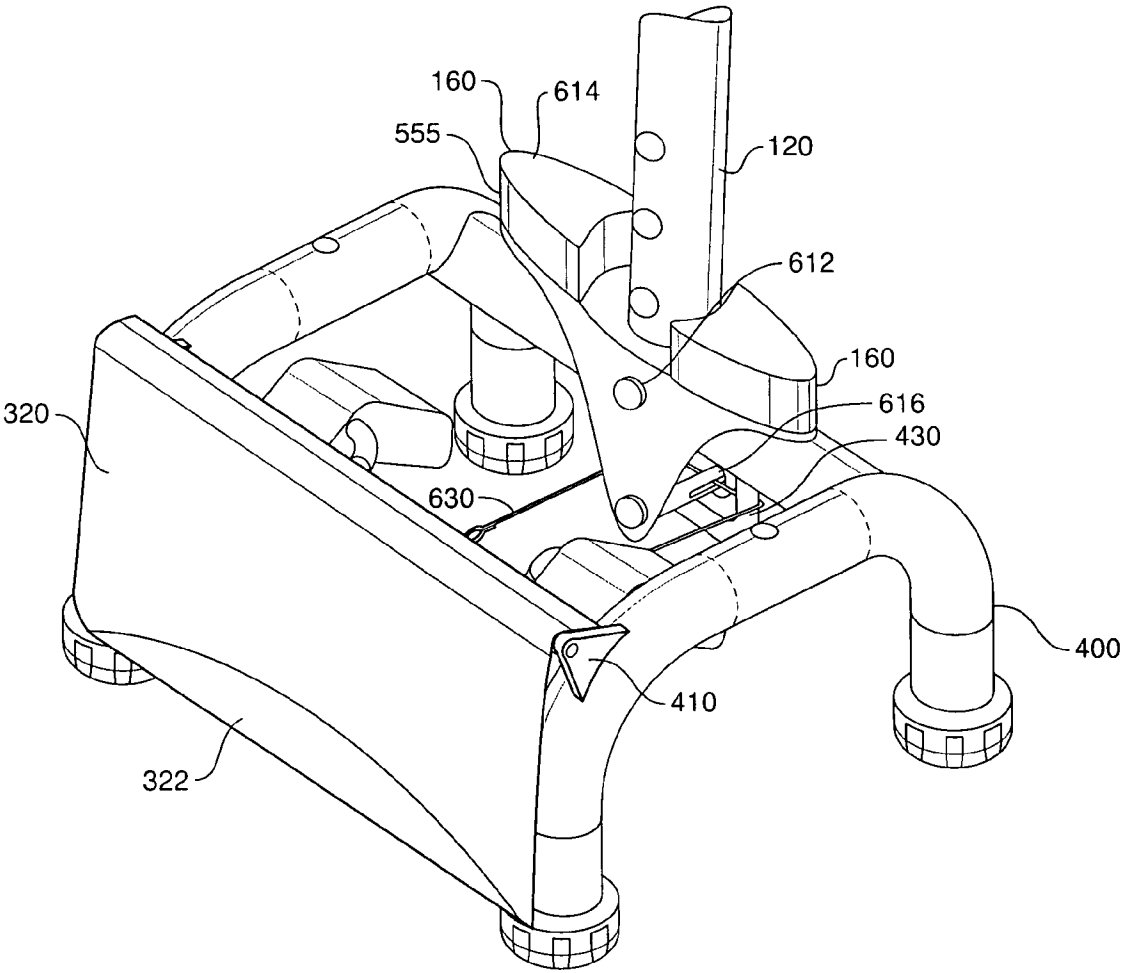
Figure 9A:
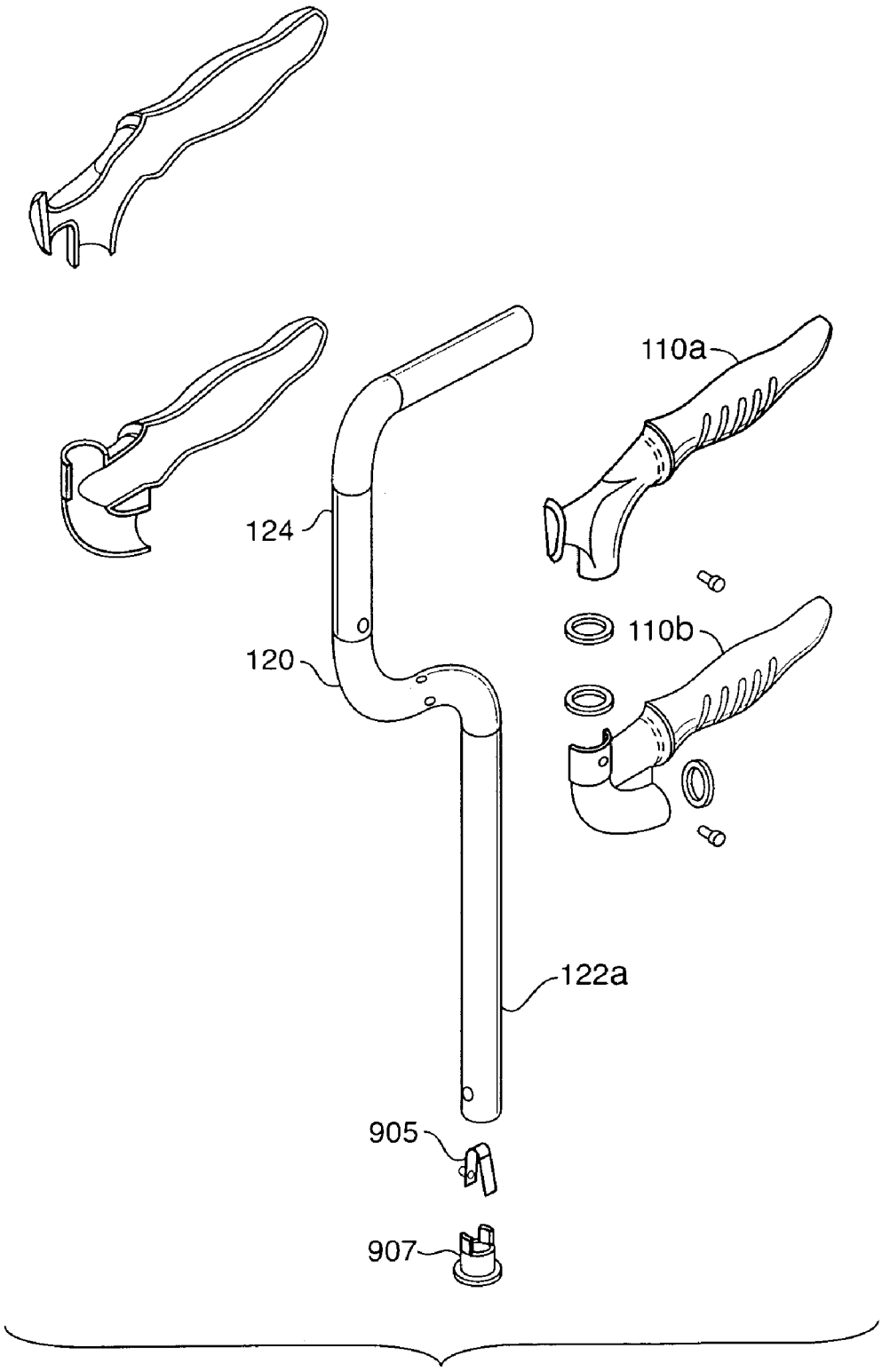
FIGS. 9A-9O depicts elements of a step-up device according to the present invention including upright 120 and handles 110 (FIG. 9A); upper handle 110*a* (FIG. 9B-1 to 9B-8); upright 120 (FIG. 9C-1 to 9C-2); lower handle 110*b* (FIG.
Figures 2, 9C:
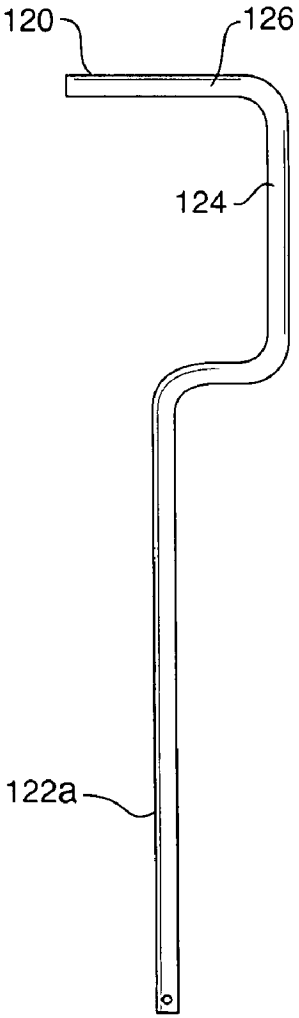
Figures 1, 9C:
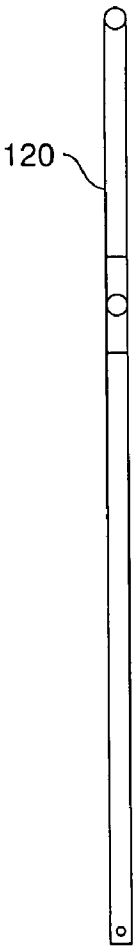
Figures 1, 9D:
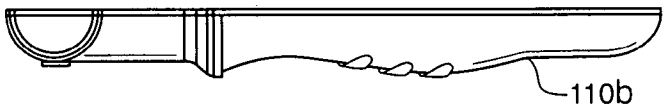
Figures 2, 9D:
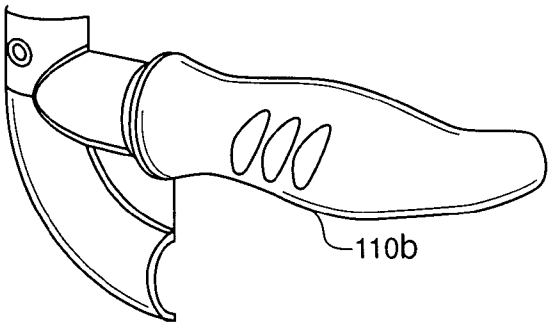
Figures 3, 9D:
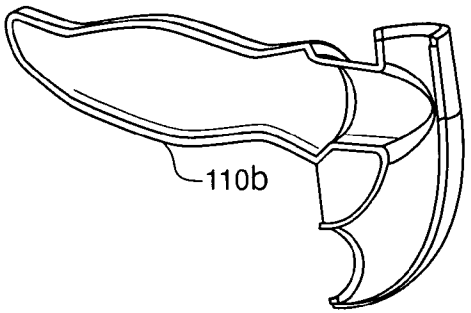
Figures 4, 9D:
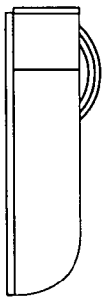
Figures 5, 9D:
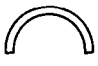
Figures 6, 9D:
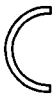
Figures 7, 9D:
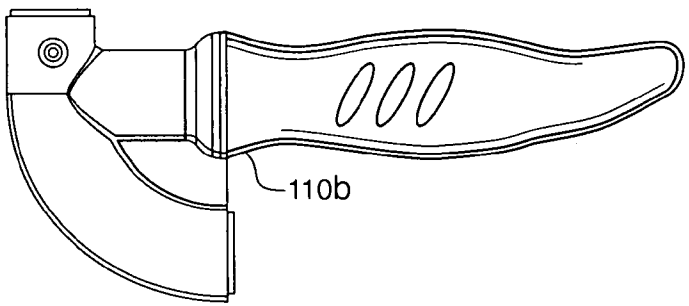

9D-1 to 9D-8); second surface 320 (FIG. 9E-1 to 9E-6); lower upright 122*a* (FIG. 9F-1 to 9F-3); actuator 160 (FIG. 9G-1 to 9G-6); foot 136 (FIG. 9H-1 to 9H-4); pivot rod 420 (FIG. 9I-1 to 9I-2); housing 134 (FIG. 9J-1 to 9J-8); leg 640 (FIG. 9K-1 to 9K-3); pinch bolt 617 (FIG. 9L-1 to 9L-2); linkage member 630 (FIG. 9M); pivot clamp 626 (FIG. 9N-1 to 9N-5); handle with accessory 140 (FIG. 9O-1 to 9O-4).

DESCRIPTION OF THE PREFERRED EMBODIMENTS

Reference will now be made in detail to preferred embodiments of the present invention, examples of which are illustrated in the accompanying drawings. Wherever possible, the same reference numbers will be used throughout the drawings to refer to the same or like parts. To provide a thorough understanding of the present invention, numerous specific details of preferred embodiments are set forth including material types, dimensions, and procedures. Practitioners having ordinary skill in the art, will understand that the embodiments of the invention may be practiced without many of these details. In other instances, well-known devices, methods, and processes have not been described in detail to avoid obscuring the invention.

Figure 1A:
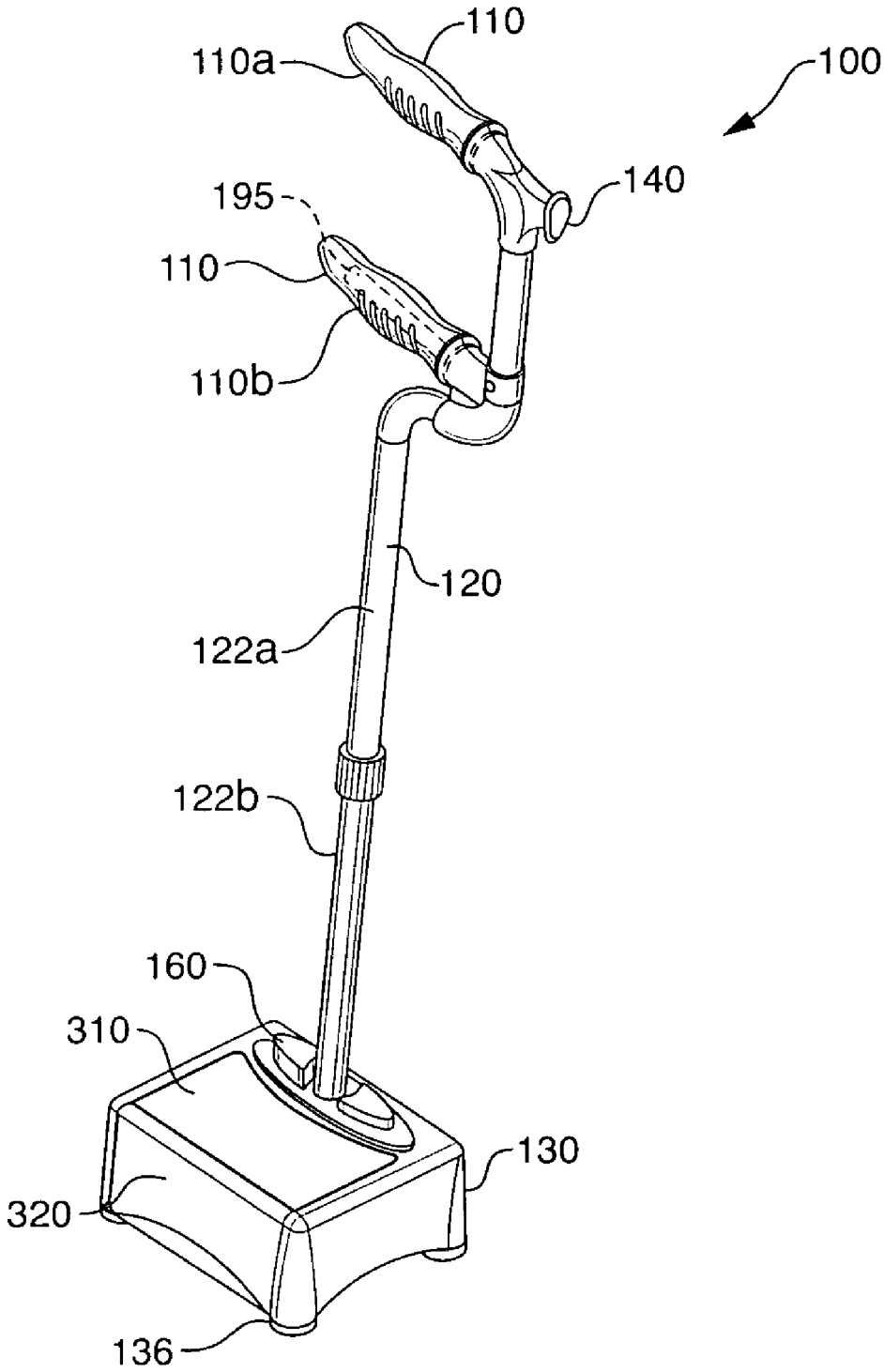
FIGS. 1A-1G depict a step-up device according to the present invention.
Figure 1B:
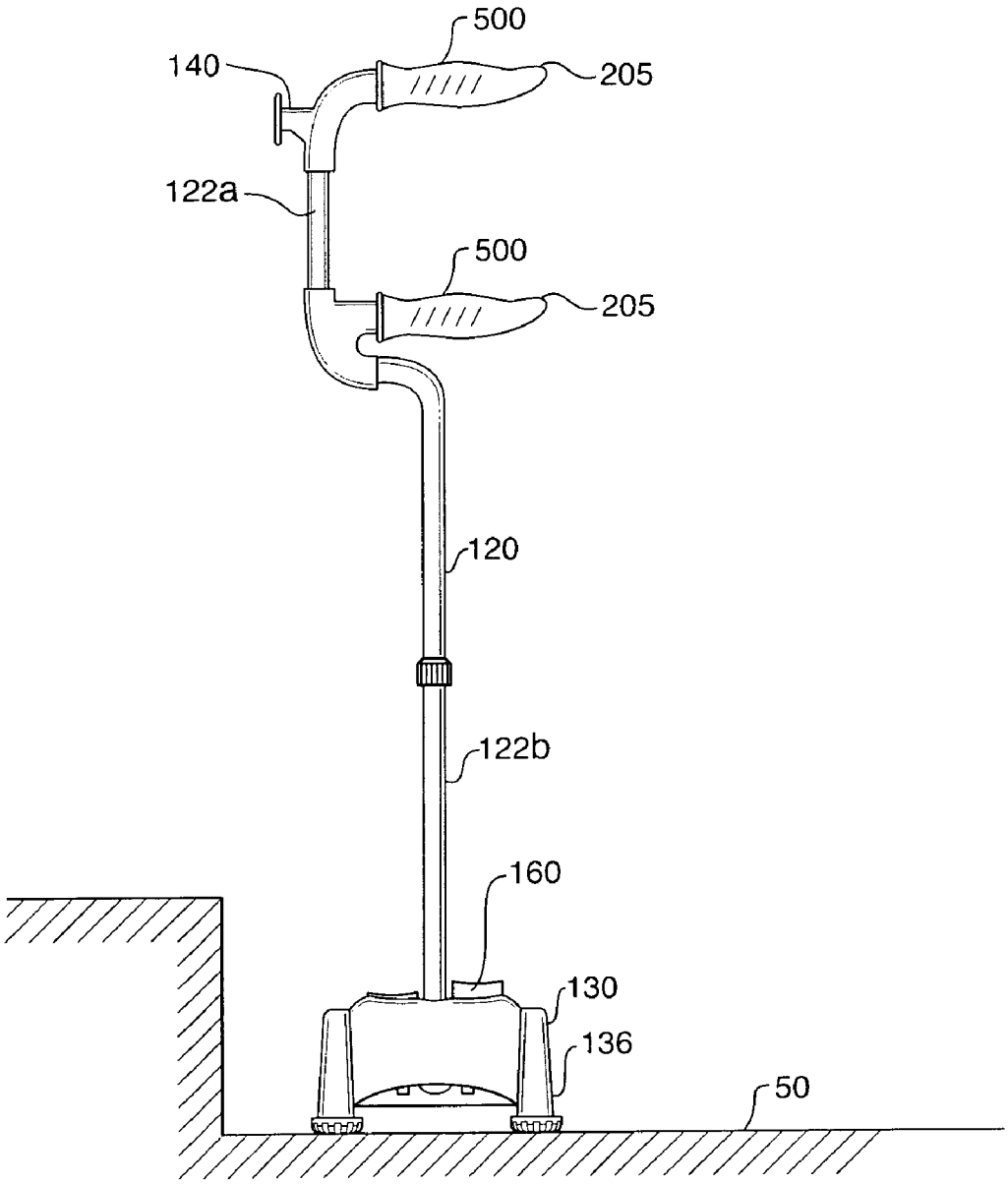
Figure 1C:
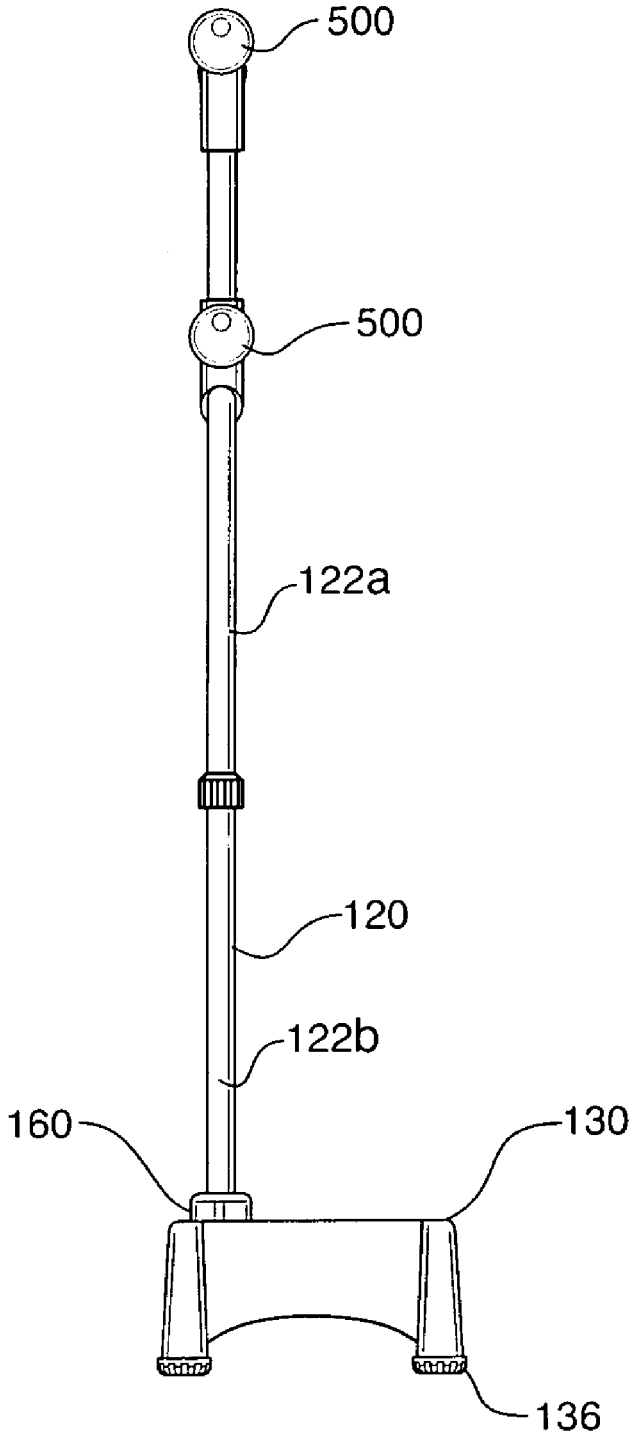
Figure 1D:
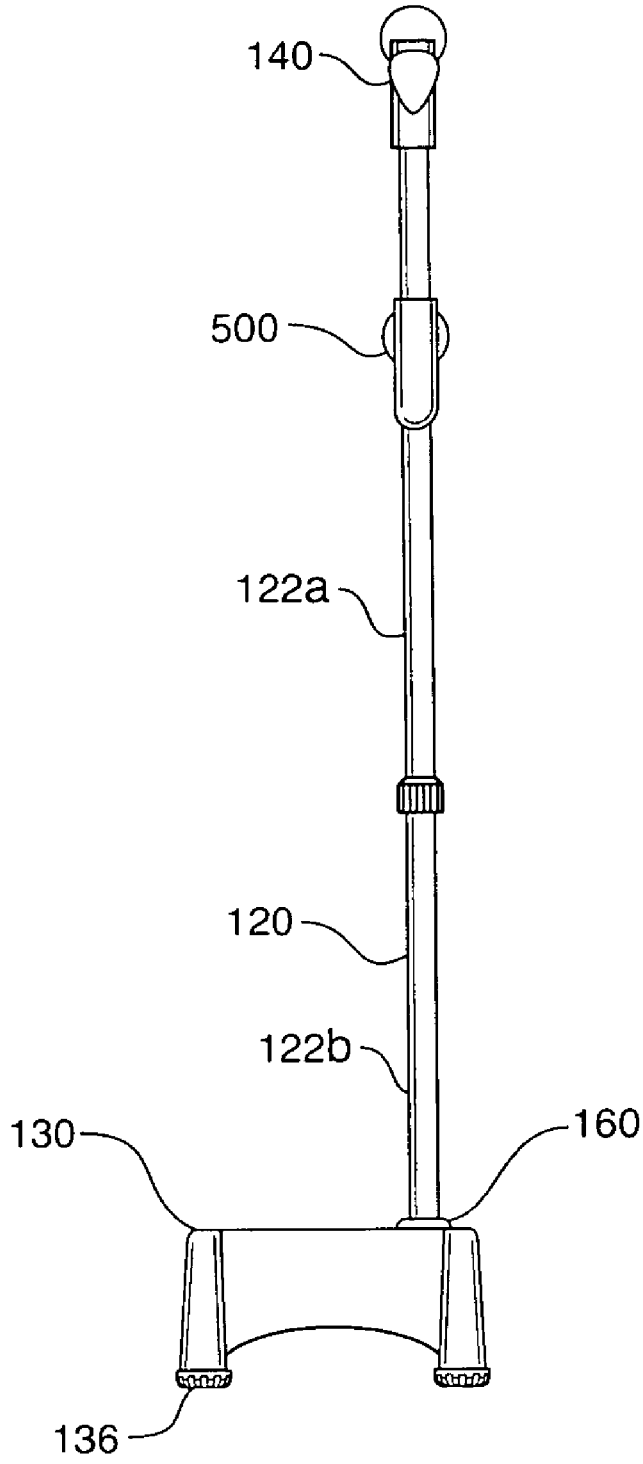

The present invention is directed to a step-up device that enables a user to step-up above datum surface 50 (e.g., a floor, ground, stair or other surface as illustrated in FIG. 1B). FIGS. 1A-1F illustrates a step-up device 100. In FIGS. 1A-1F, step-up device 100 includes a handled upright shaft such that step-up device can be used as a cane. In other embodiments, step-up device 100 includes any device that one might wish to use to facilitate elevating above a datum surface 50 (e.g., a floor, ground, stair or other surface as illustrated in FIG. 1B) with or without a shaft, upright or the like. For example, in one embodiment, step-up device 100 includes a step ladder (not shown). In one embodiment, step-up device 100 is constructed of any suitable material including without limitation, polymer, metal, fiberglass, wood or any other suitable material or combination of materials. In one embodiment, step-up device 100 includes ABS thermoplastic and/or aluminum. In a preferred embodiment, illustrated in FIG. 1A, step-up device 100 includes handles 110, upright 120, base 130, hook 140 and actuator 160.

Figure 1E:
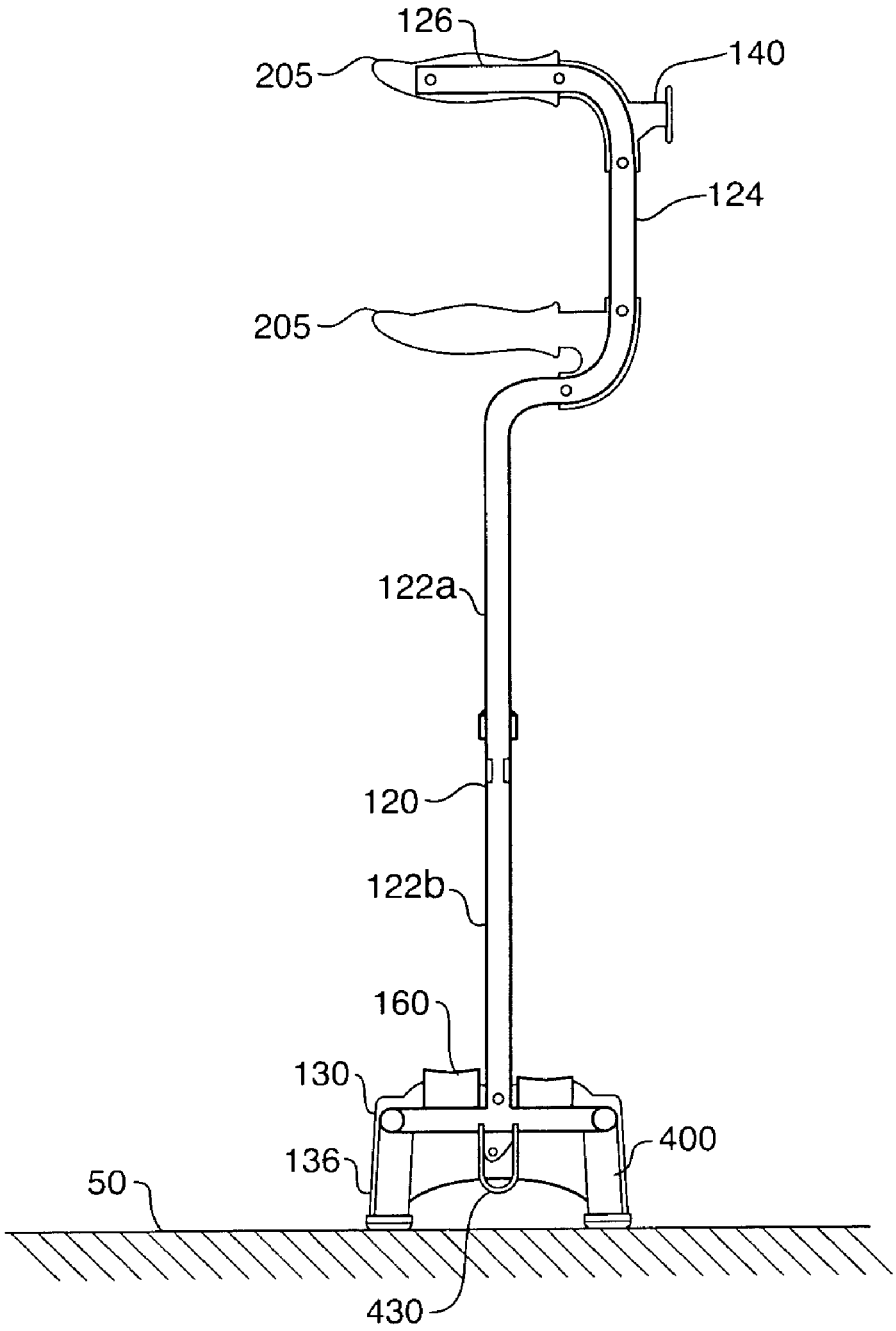
Figure 1F:
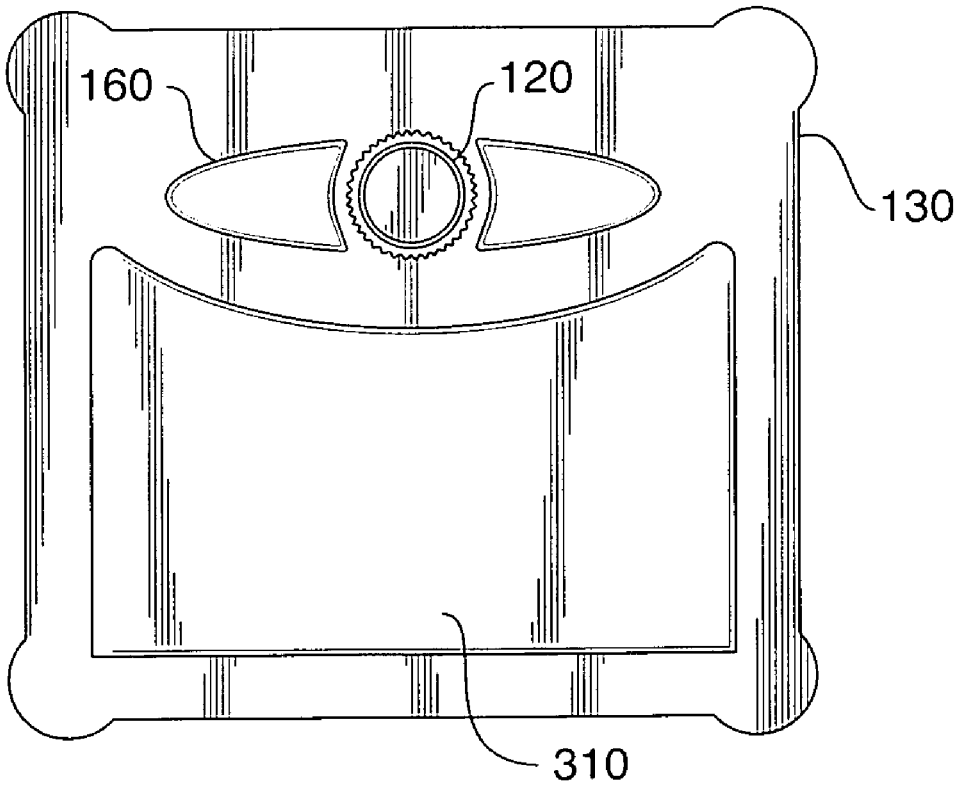
Figure 1G:
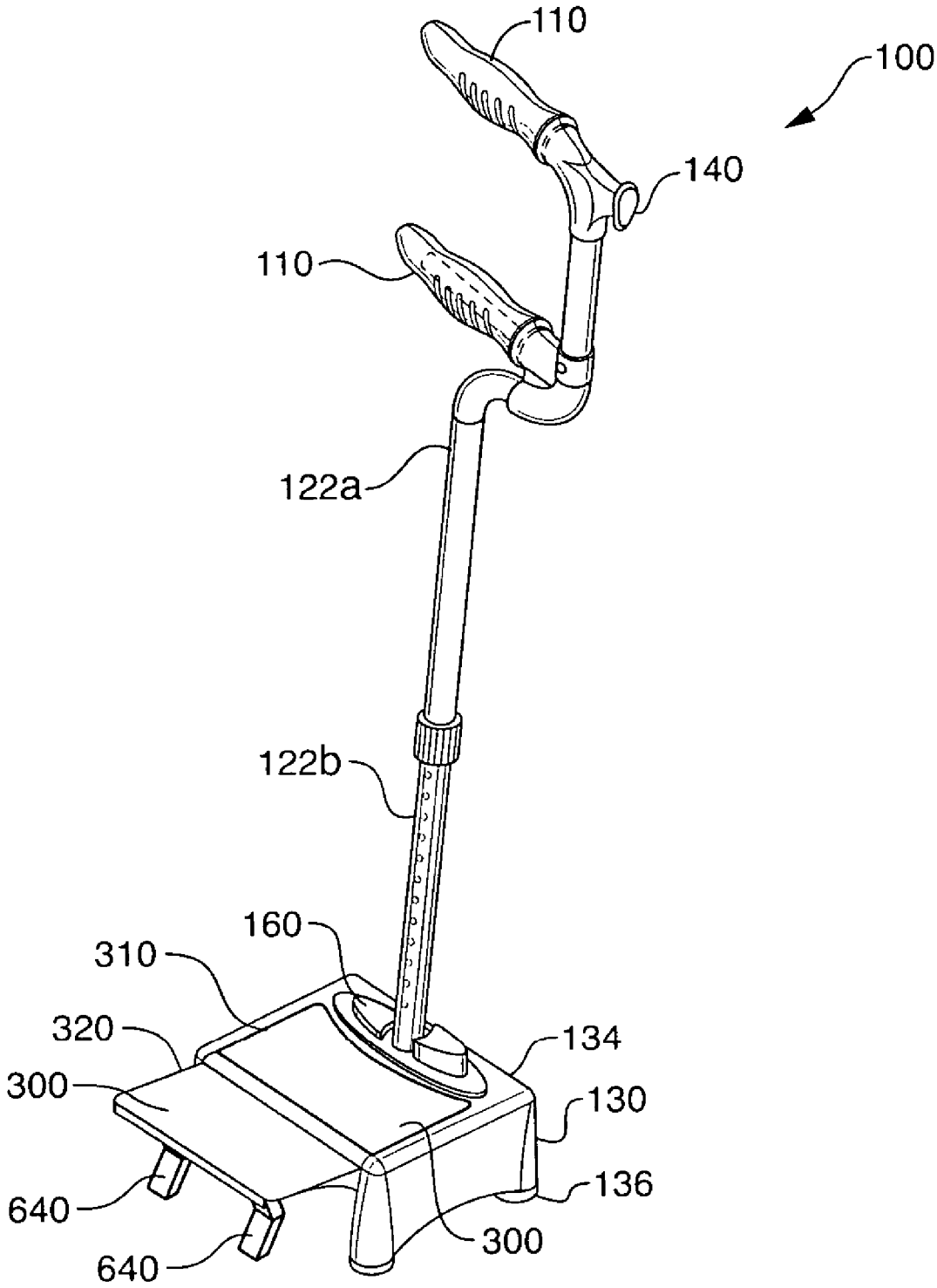
Figure 3A:
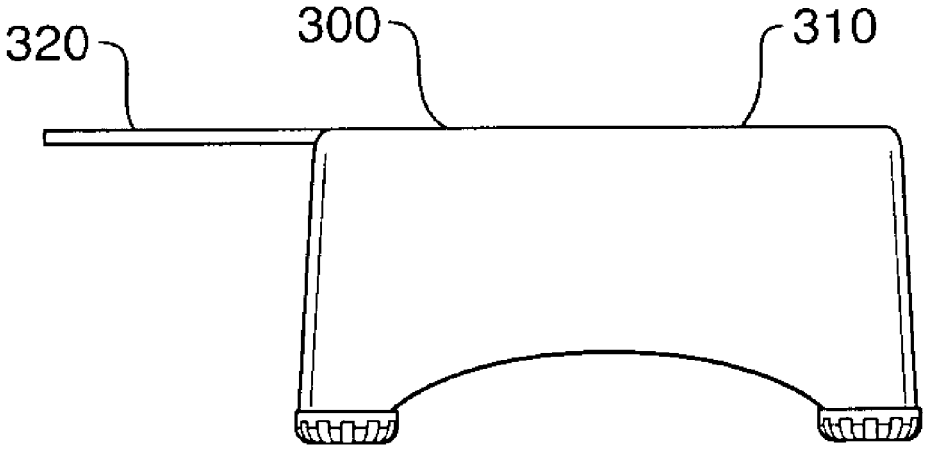
FIG. 3A illustrates a step-up device with an extended platform according to the present invention.

One embodiment of base 130 is illustrated in FIGS. 3B, 4A-1 to 4A-5, and 4B. Base 130 preferably has a first surface 310 and a second surface 320. In a preferred embodiment, first surface 310 and second surface 320 include textured surface 330. In one embodiment, second surface 320 is movable relative to first surface 310 to form an extendable platform 300 (FIGS. 1G and 3A). In one embodiment, second surface 320 is pivotable relative to first surface 310. First surface 310, second surface 320 and extendable platform 300 may be of any shape. Preferably, first surface 310, second surface 320 and extendable platform 300 are rectangular. In one embodiment, second surface 320 has a door-type configuration 950 (e.g., FIG. 9E-1 to 9E-6). In a preferred embodiment, base 130 is configured to resemble a three-dimensional rectangular box having a first surface 310 that is a rectangular horizontal surface and a second surface 320 that is oriented substantially perpendicular to first surface 310 when it is retracted and substantially co-planar to first surface 310 when it is extended. Base 130 is preferably configured to accommodate a user standing on platform 300, first surface 310 (e.g., when second surface 320 is or is not in an extended position) and/or on second surface 320 (e.g., when second surface 320 is in an extended position). In one embodiment base 130 is configured to accommodate a user weighing up to approximately 500 pounds. In one embodiment, base 130 is configured to accommodate a user weighing approximately 250 pounds. Base 130 preferably is also configured to enclose components of linkage (e.g., actuator assembly 600) (described below). Preferably base 130 has a height above datum surface 50 (e.g., a floor, ground, stair or other surface as illustrated in FIG. 1B) less than the height of a common riser on a stair. Preferably the height of base 130 is substantially half that of a common stair riser.

Figure 3B:
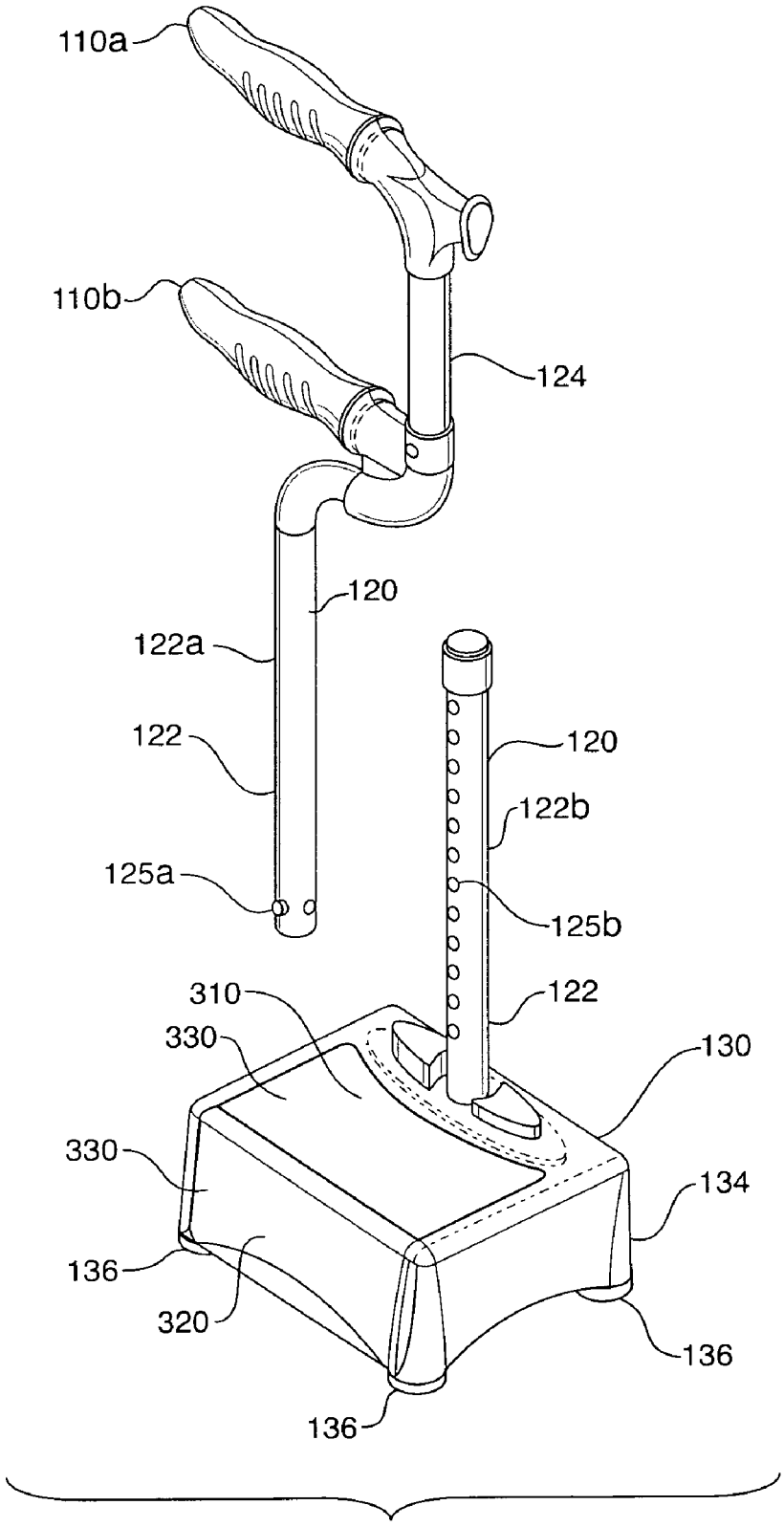
FIG. 3B depicts a partially disassembled step-up device according to the present invention.

In one embodiment, illustrated on FIG. 3B, a structure such as upright 120 (shown in FIG. 1E) is positioned proximate one side of base 130 (e.g., proximate a mid-point of the long side of a rectangular first surface 310). In one embodiment, at least a portion of upright 120 (e.g., vertical shaft 122) is oriented normal to the surface of platform 300. In one embodiment, at least a portion of upright 120 is oriented obtuse to the surface of platform 300. In one embodiment, the location of a structure such as upright 120 relative to platform 300 is selected to maximize the usable surface of platform 300. If platform 300 is too small, for example, a user standing on platform 300 would have a tendency to be unstable. For example, if a user standing on platform 300 is too close to a structure such as upright 120, the user tends to lean away from the structure (e.g., upright 120) such that a user is not balanced over platform 300. In one embodiment, second surface 320 is extended to enable a user to balance on, for example, second surface 320 and/or extended platform 300 (e.g., which may include both second surface 320 and first surface 310), at a distance that is far enough away from a structure (e.g., upright 120) to comfortably stand or step while still having the structure (e.g., upright 120) available to steady the user. In one embodiment, the relative position of base 300 and a structure (e.g., upright 120) enables a user to use step-up device 100 such that the structure (e.g., upright 120) is positioned between the user and platform 300. In one embodiment, this configuration is preferred when step-up device 100 is a cane used to assist a user in walking. For example, when a user who has been walking with the assistance of step-up device 100 reaches an elevation change for which the user needs the assistance of the platform 300, the user can rotate step-up device 100 about the structure (e.g., upright 120) and comfortably stand on platform 300. In one embodiment, step-up device 100 is configured such that it remains upright without user intervention whether the device includes upright 120 or does not include upright 120.

Base 130 preferably includes housing 134, frame 400 (e.g., FIGS. 4A-1 to 4A-5, 4B, 9J-1 to 9J-8, 9H-1 to 9H-4) and feet 136. In one embodiment, housing 134 includes first surface 310 and second surface 320 (e.g., as described above). In one embodiment, feet 136 provide support between datum 50 and base 130. In one embodiment, feet 136 are of any material including polymer (e.g., thermoplastic, elastomer, rubber).

Figures 8, 9D:
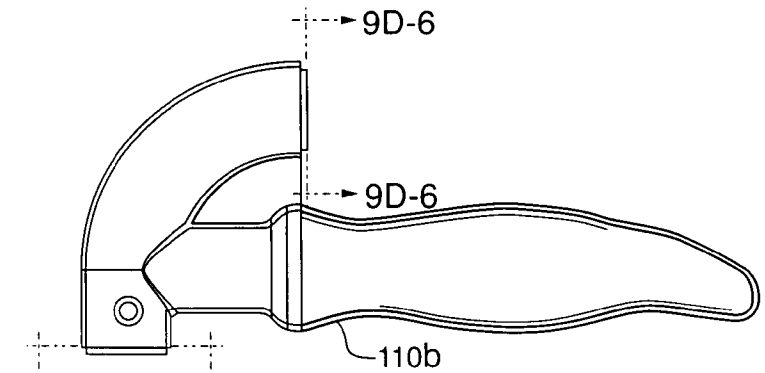
Figures 1, 9F:
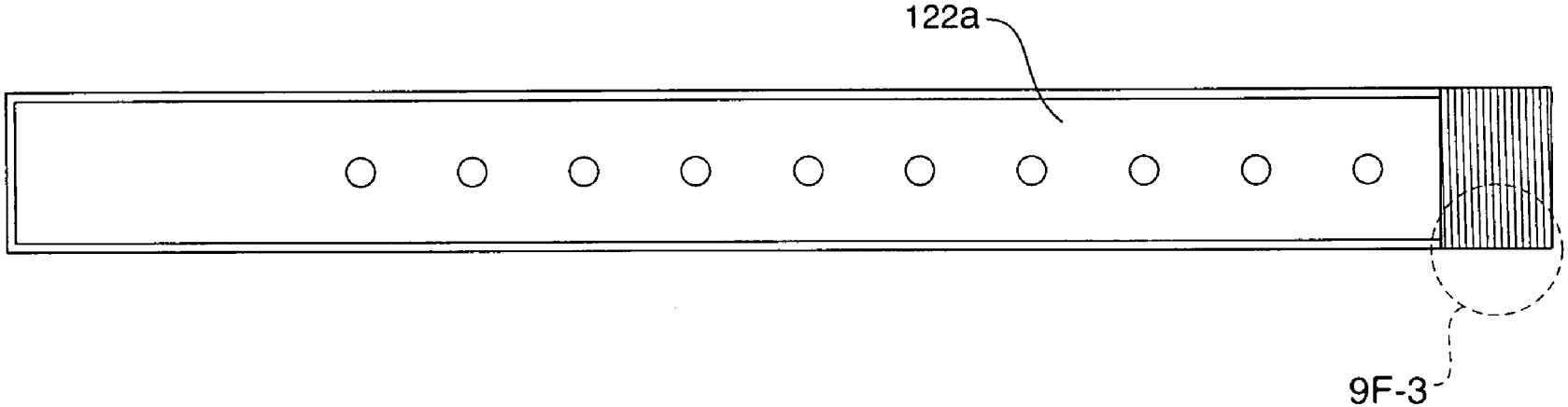
Figures 3, 9F:
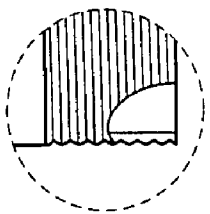
Figures 2, 9F:
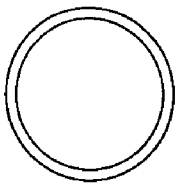
Figures 3, 9G:
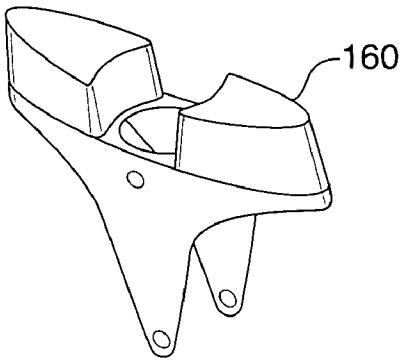
Figures 2, 9G:
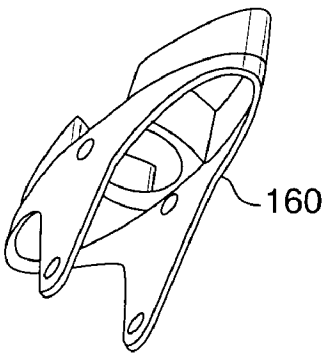
Figures 1, 9G:
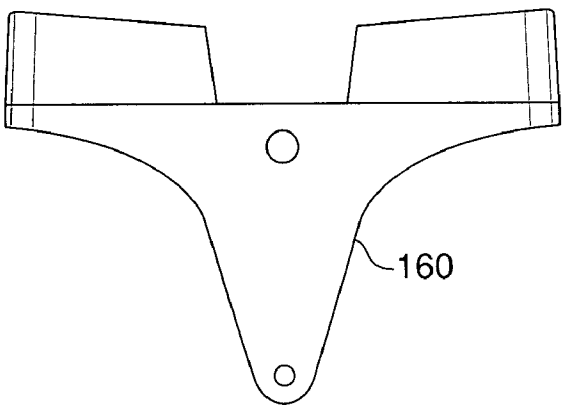
Figures 6, 9G:
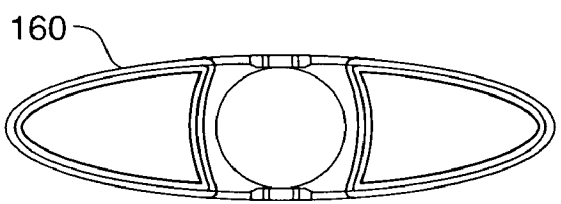
Figures 5, 9G:
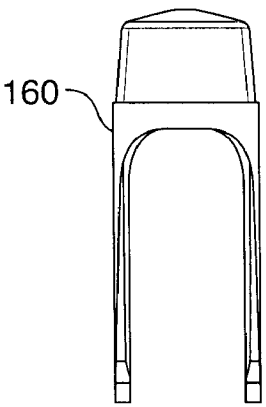
Figures 4, 9G:
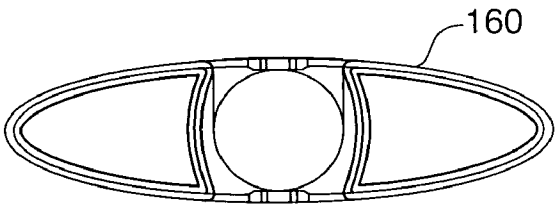
Figures 4, 9H:
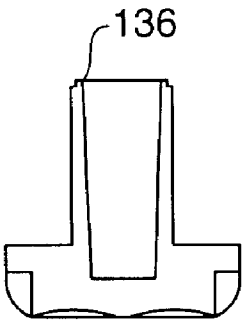
Figures 3, 9H:
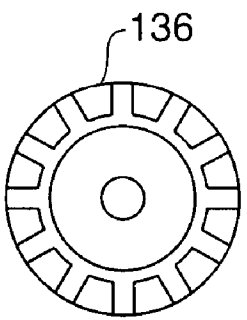
Figures 2, 9H:
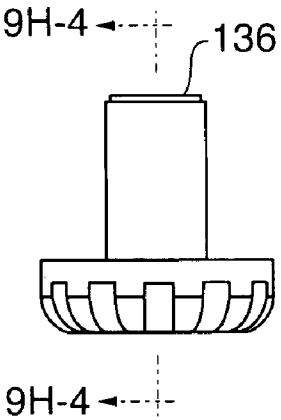
Figures 1, 9H:
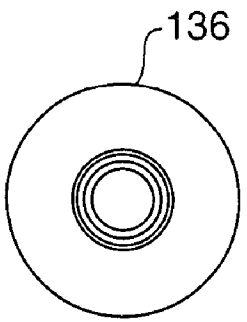
Figures 2, 9I:
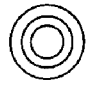
Figures 1, 9I:
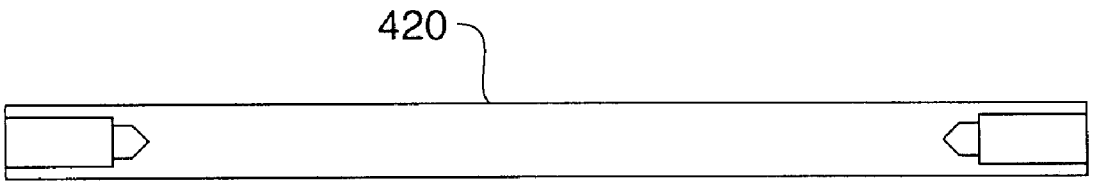
Figures 1, 9J:
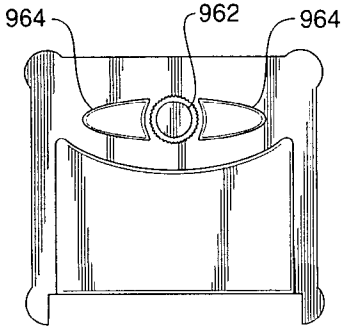
Figures 2, 9J:
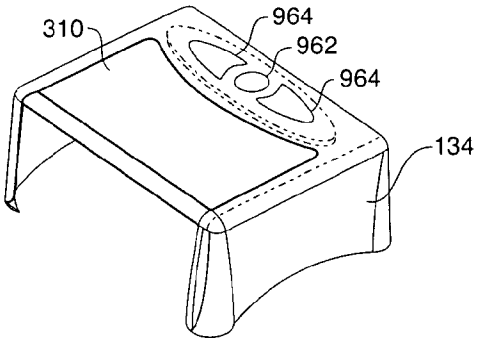
Figures 3, 9J:
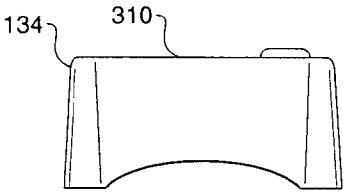
Figures 4, 9J:
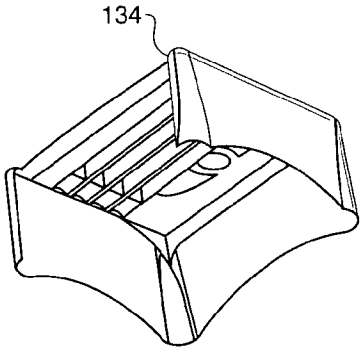
Figures 5, 9J:
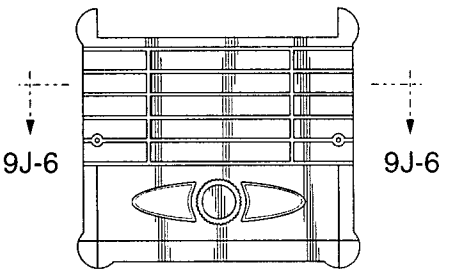
Figures 6, 9J:
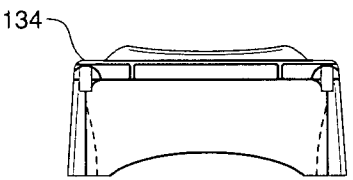
Figures 7, 9J:
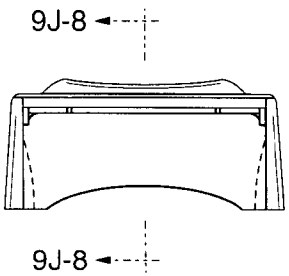
Figures 8, 9J:
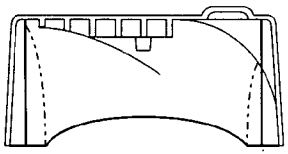
Figures 3, 9K:
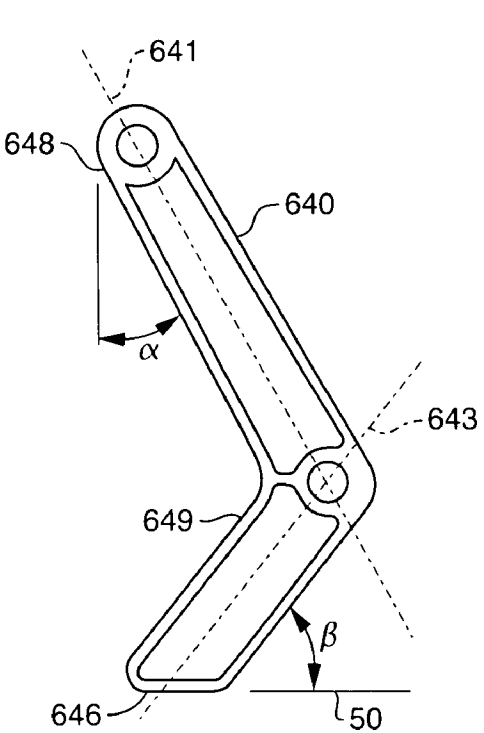
Figures 2, 9K:
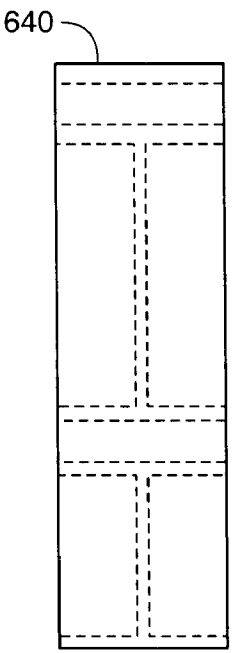
Figures 1, 9K:
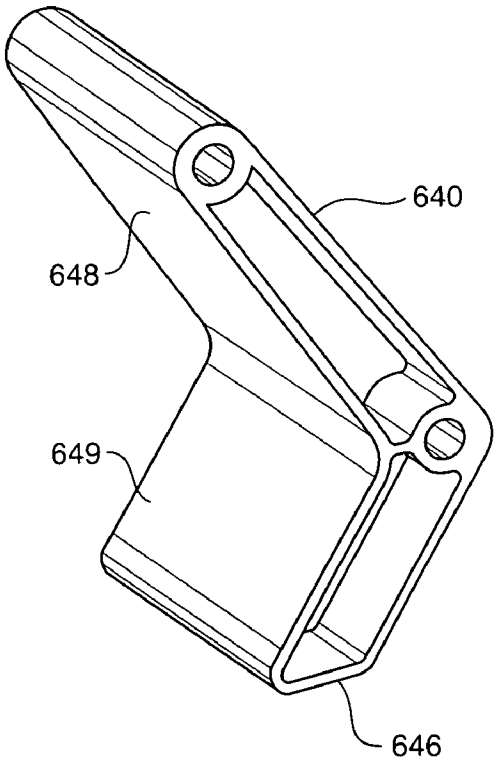

Housing 134 and frame 400 are preferably separate components though they may be a single integral component. Preferably, housing 134 is molded polymer and frame 400 is metal but either component may be of any material. One embodiment of housing 134 is illustrated in FIG. 9J-1 to 9J-8. In one embodiment, housing 134 includes upright aperture 962. In one embodiment, upright 120 extends through upright aperture 962 and is connected to base 130 within housing 134. In one embodiment, housing 134 includes at least one actuator apertures 964. In one embodiment, actuator 160 extends through at least one of the actuator apertures 964 and is connected to base 130 within housing 130. In one embodiment, housing 134 at least partially encloses linkage configured to operate the extendible platform 300.

As shown in FIG. 4A-1 to 4A-5 and 4B, frame 400 may be of one or more individual components. In one embodiment, frame 400 is a rigid frame. In one embodiment, frame 400 is welded or glued frame (e.g.; gluing, welded tubing). In one embodiment, frame 400 is a single integral component (e.g., a cast frame). Frame 400 is preferably secured to upright 120 by any connection means.

In one embodiment, second surface 320 is pivotable relative to base 130. In one embodiment second surface 320 pivots about pivot rod 420. In one embodiment, frame 400 preferably includes two pivot brackets 410 for securing pivot rod 420 and guide 430. Second surface 320 preferably pivots about pivot rod 420 to extend platform 300 (e.g., as described herein). In a preferred embodiment, frame 400 is of a size that is large enough such that when housing 134 is secured it can comfortably be stepped-upon and small enough that step-up device 100 easily can be carried. In one embodiment illustrated in FIG. 4A-1 to 4A-5, to accomplish these objectives, the width $w_f$ (FIG. 4A-1 to 4A-5) of frame 400 as measured from upright 120 and to the outer end of frame 400 is approximately between 4 inches and 8 inches. In one embodiment, width $w_f$ is approximately 5 inches. Preferably, the length $l_f$, (illustrated in FIG. 4A-1 to 4A-5) of frame 400 is approximately 6¾ inches. The preferable height, $h_f$, of frame 400 (illustrated in FIG. 4A-1 to 4A-5) is approximately between 2 inches and 5 inches. In one embodiment, height, $h_f$ is approximately 3 inches.

Figure 6A:
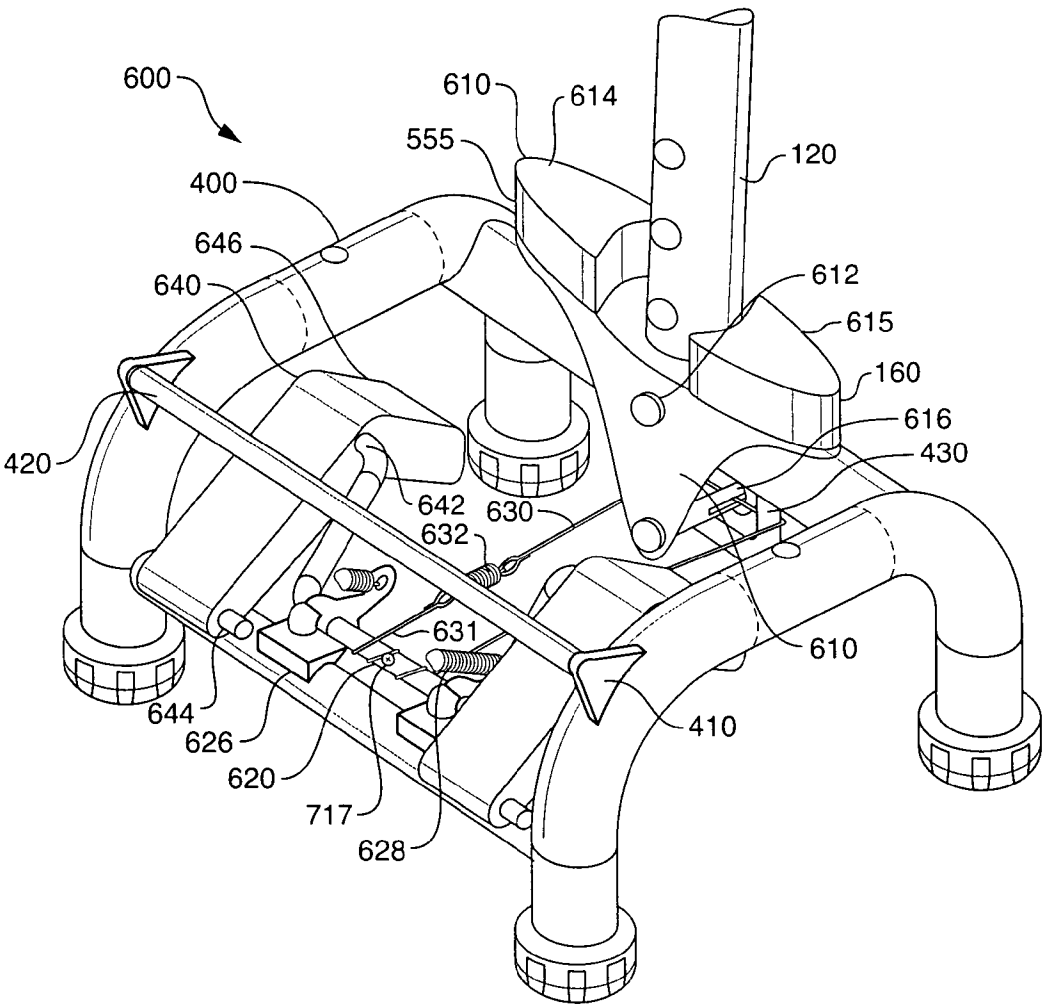
FIG. 6A depicts a cutaway view of a partially assembled actuator of a step-up device according to the present invention.
Figures 1, 6B:
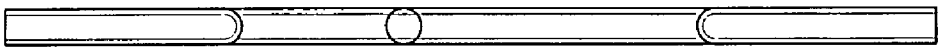
Figures 2, 6B:
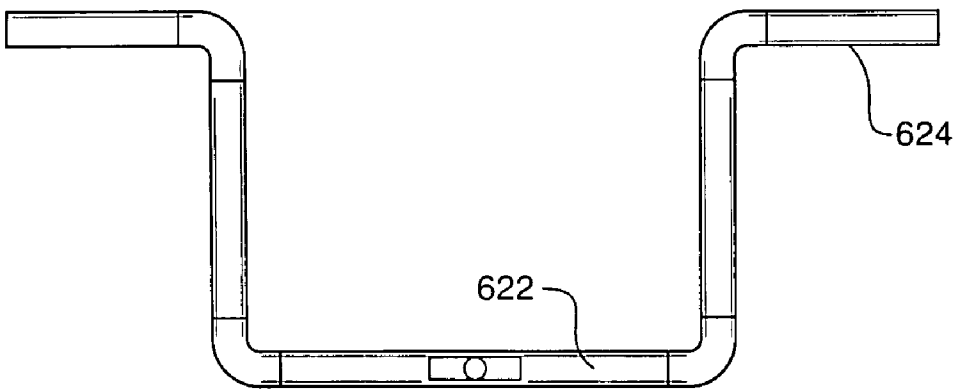
Figures 3, 6B:
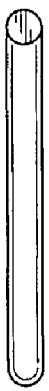
Figure 6C:
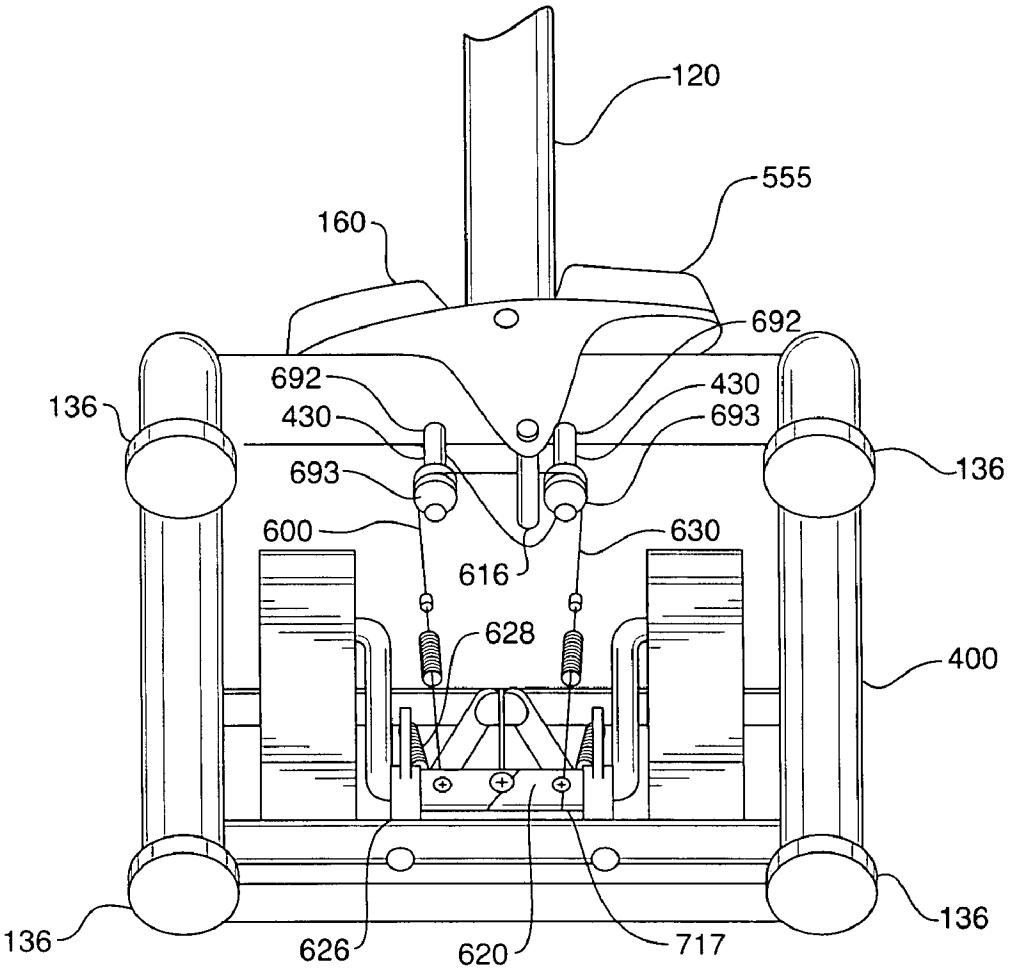
FIG. 6C illustrates a perspective view of linkage of an actuator assembly of the present invention.
Figures 3, 6D:
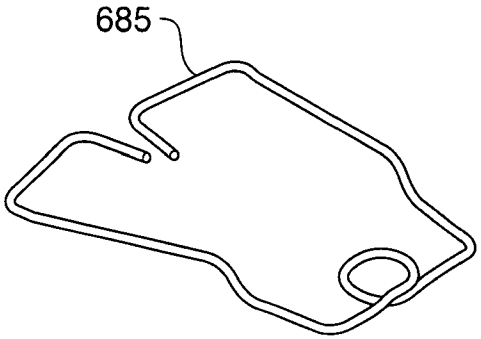
Figures 2, 6D:
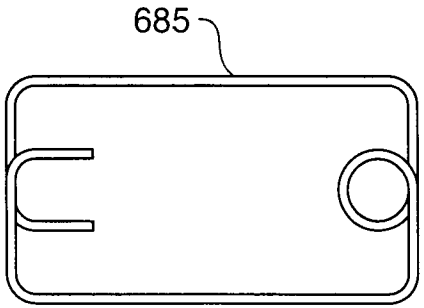
Figures 1, 6D:
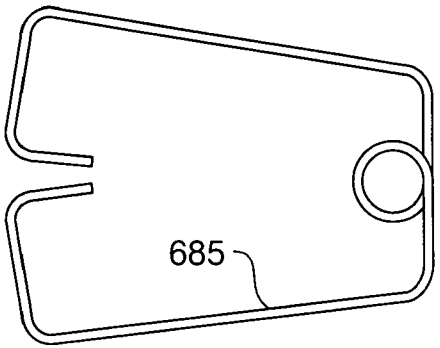
Figures 5, 6D:
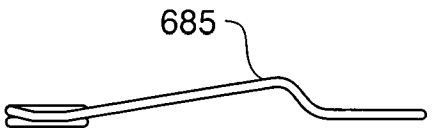
Figures 4, 6D:
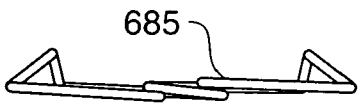

In one embodiment, illustrated in FIG. 6A, step-up device 100 preferably has linkage (e.g., including actuator assembly 600). Actuator assembly 600 preferably is operated to extend or retract platform 300. In one embodiment, actuator assembly 600 links actuator 160 with second surface 320. In a preferred embodiment, actuator 160 and actuator assembly 600 have a first position corresponding to an extension of platform 300 and a second position corresponding to a retraction of the platform 300. In a preferred embodiment, platform 300 is extended when actuator 160 is operated and it is retracted when actuator 160 is operated. In one embodiment, actuator 160 is located proximate base 130. In one embodiment, for example, actuator 160 is proximate both upright 120 and base 130. In one embodiment, actuator 160 is located proximate a connection point between upright 120 and base 130. In one embodiment, actuator 160 is operable as a foot pedal. Preferably, actuator 160 is configured to at least partially wrap around upright 120 (FIG. 1F). In one embodiment, actuator 160 toggles between the first position and the second position. In one embodiment, actuator 160 and actuator assembly 600 are configured such that the toggling operation (e.g., an extended position with actuator 160 rocked to one side and a retracted position with actuator 160 rocked to the other side) of actuator 160 causes platform 300 to toggle between and extended and a retracted position.

Figure 8A:
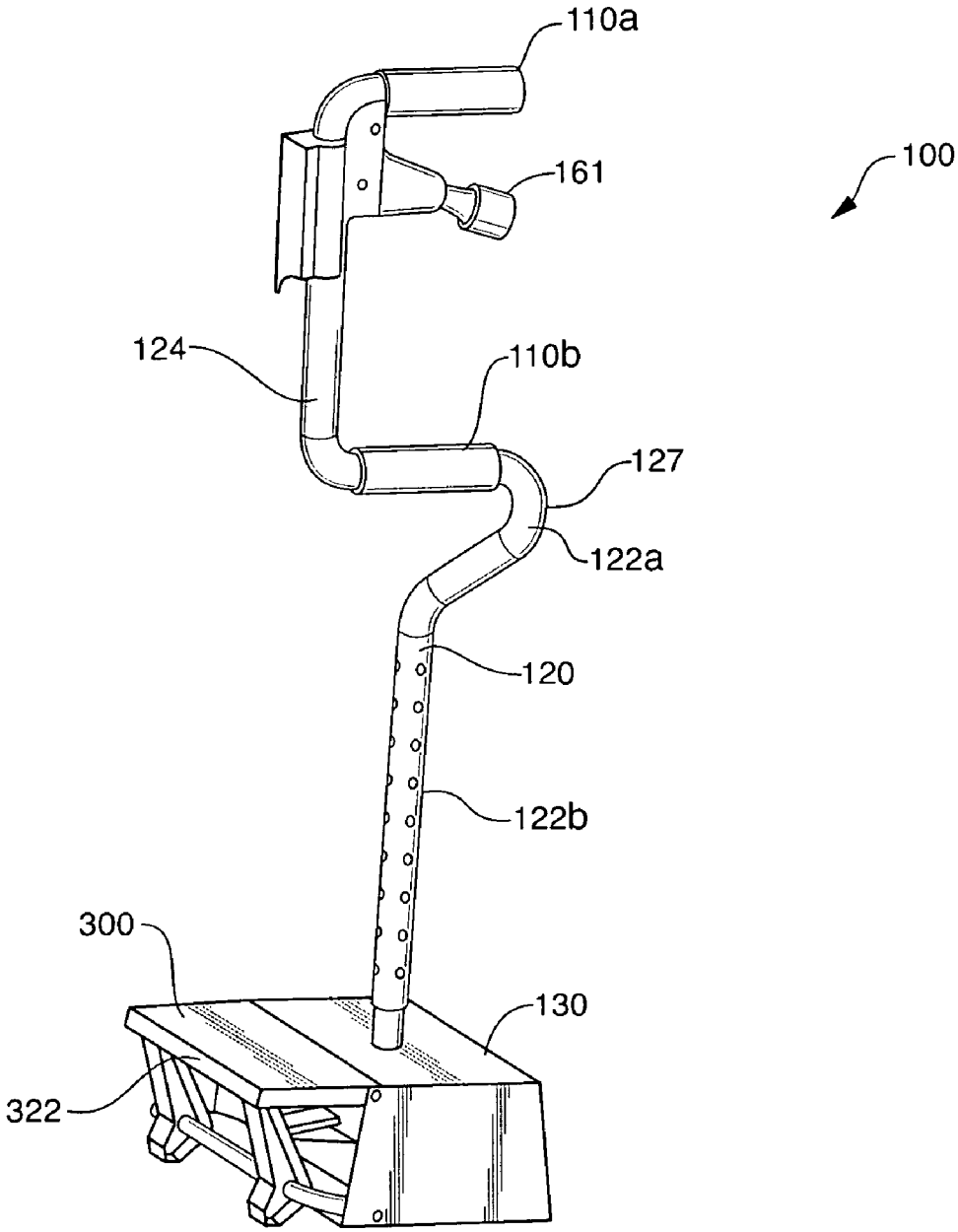
FIG. 8A depicts a step-up device with a hand actuator according to the present invention.
Figure 8B:
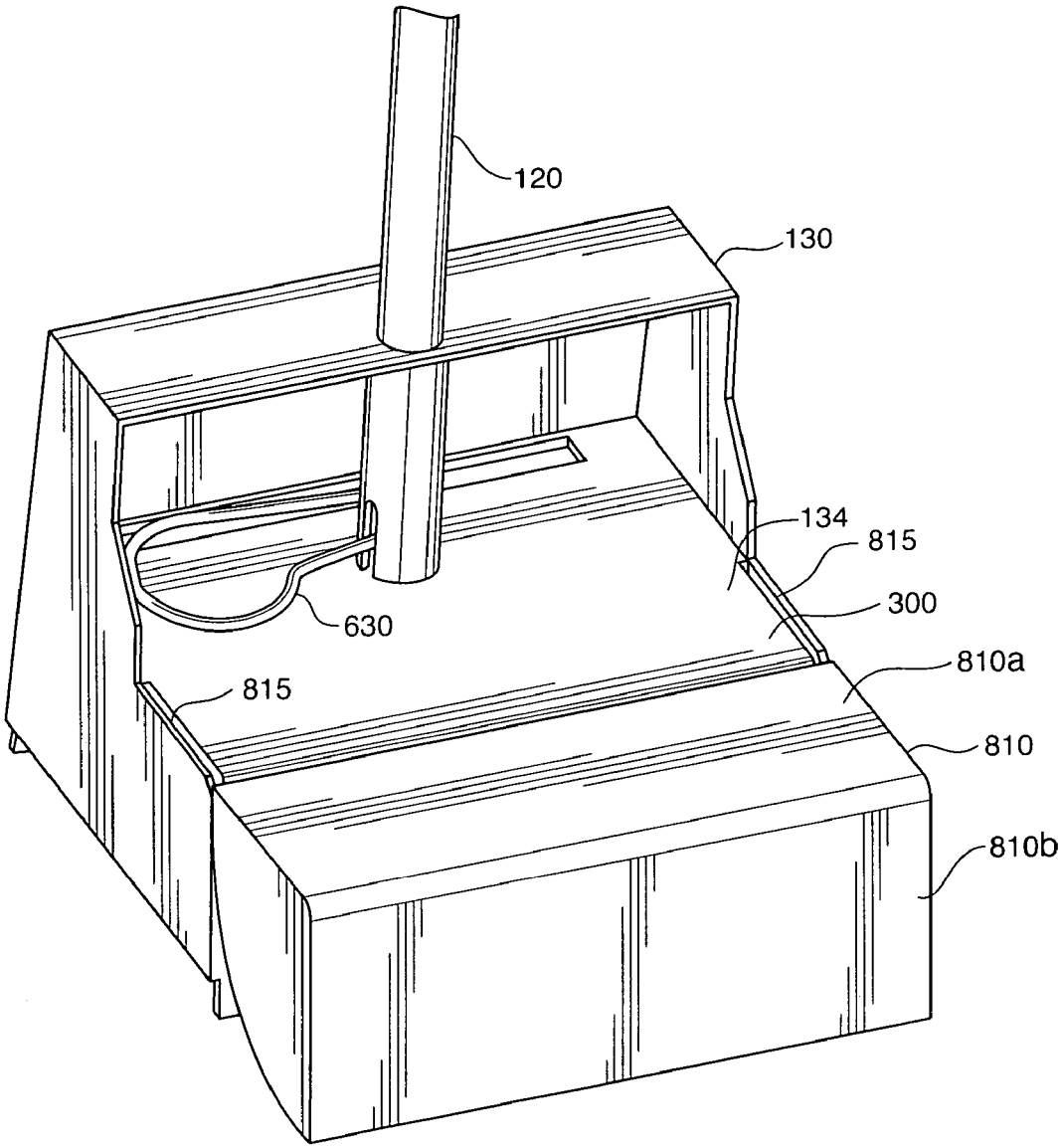
FIG. 8B depicts one embodiment of a base according to the present invention.
Figure 8C:
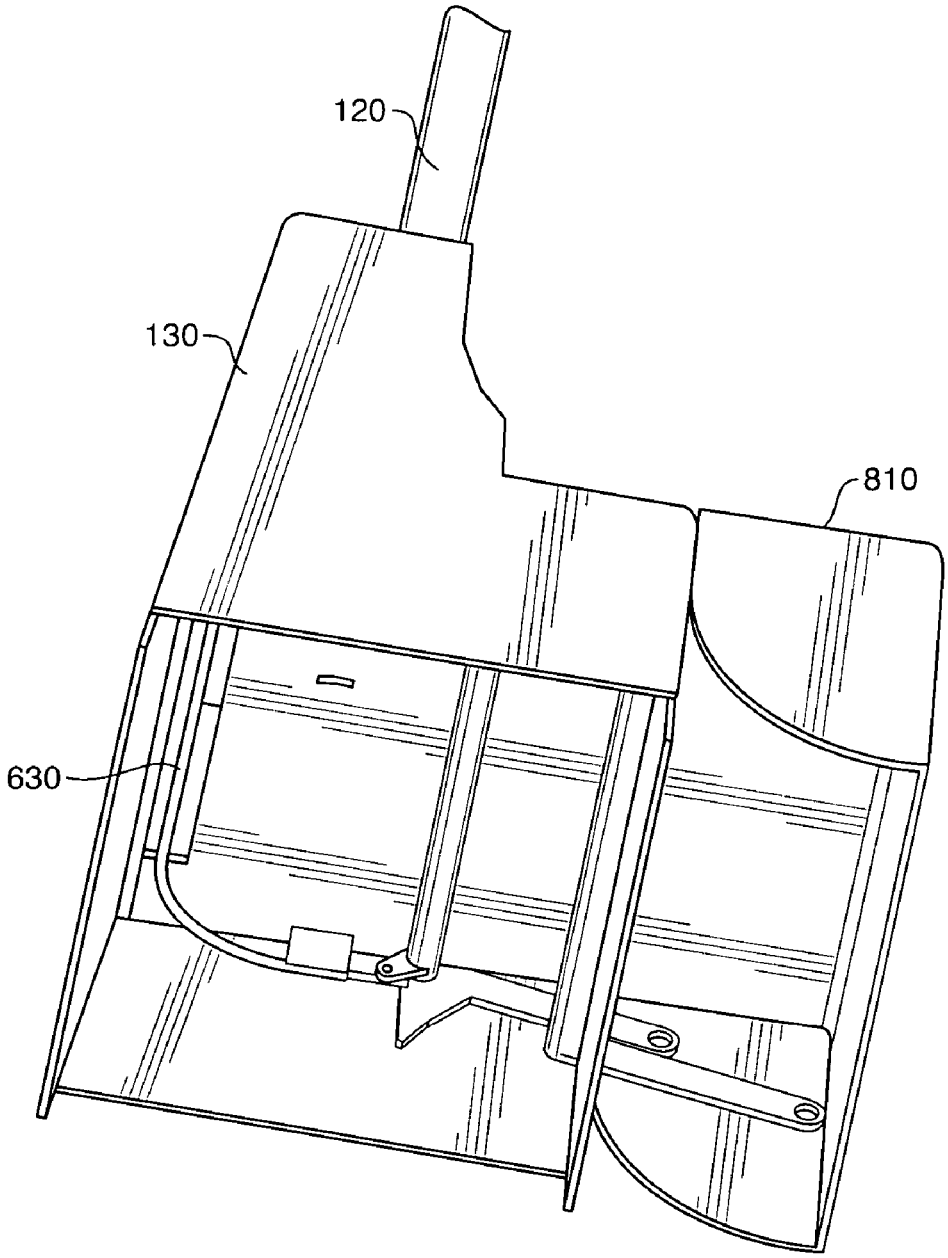
FIG. 8C illustrates a portion of an actuator assembly and base according to the present invention.

In one embodiment, actuator 160 includes hand actuator 161. For example, in one embodiment, hand actuator 161 is located proximate handles 110 and/or upright 120. (FIG. 8A). In one embodiment, hand actuator 161 is linked to actuator assembly 600 (e.g., via linkage member 630 (e.g., a cable)). Preferably, hand actuator 161 is engaged to extend platform 300 (e.g., illustrated in FIG. 8A). In one embodiment, illustrated in FIG. 8B linkage member 630 extends to hand actuator 161 via upright 120. Also illustrated in FIG. 8B, the extendible platform 810 includes two faces **810*a*, 810*b*. In an extended position (illustrated in FIG. 8B) face 810*a* is substantially co-planer with platform 300 and face 810*b* is substantially perpendicular to platform 300 thereby forming a front to base 130. In a retracted position of one embodiment, extendible platform 810 rotates such that face 810*a* forms the front of base 130 substantially perpendicular to platform 300 and face 810*b* forms at least a portion of the bottom of base 130 and is substantially parallel to platform 300. In one embodiment, illustrated in FIGS. 8B and 8C, extendible platform 810 does not rotate upon operation of actuator 161. In one embodiment, extendible platform 810 slides within base 300 such that face 810*b* remains the front face of base 300. In one embodiment, channels 815 guide extendible platform 810 as it is extended and/or retracted. In FIGS. 8B and 8C, base 130 includes an enclosed housing 134 partially enclosing upright 120 and linkage member 630**.

In one embodiment, actuator 160 is double acting button 555 (e.g., FIGS. 5, 6A). In one embodiment, for example, operation of actuator assembly 600 causes second surface 320 to pivot about pivot rod 420—much as a door swings open—and retract to a perpendicular position with respect to surface 310 (e.g., second surface 320 returns to its first position) depending upon which side of actuator 160 a user applies a force.

One embodiment of actuator assembly 600 is illustrated in FIGS. 4B, 5, 6A and 6B-1 to 6B-3, 7A-7E. Actuator assembly 600 preferably includes rocker arm 610, drive link 620, linkage member 630 and legs 640. In one embodiment, rocker arm 610 has first face 614 (e.g., which can be depressed to extend platform 300), a second face 615 (e.g., which can be depressed to retract platform 300), a pivot point 612, a moment arm connector 616. Pivot point 612 is preferably between first face 614 and second face 615 as illustrated in FIG. 6A. Moment arm connector 616 is preferably a predetermined distance from pivot point 612 and between first face 614 and second face 615 as illustrated in FIG. 6. When rocker arm 610 is caused to pivot, preferably for example, when first face 614 or second face 615 is depressed, moment arm connector 616 travels within the boundary of guide 430.

Figure 2:
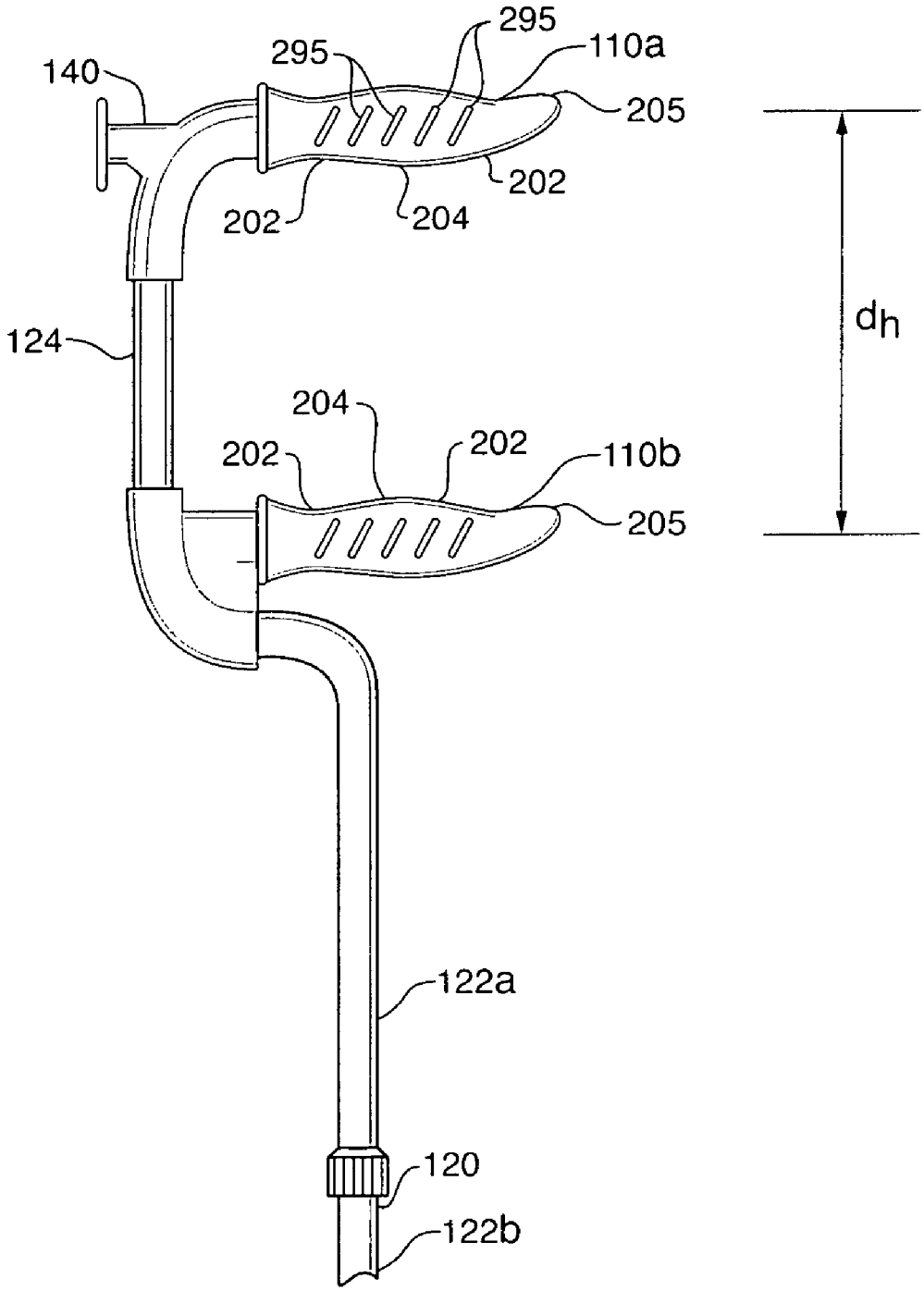
FIG. 2 depicts handles of a step-up device shown in FIG. 1 according to the present invention.
Figures 2, 9L:
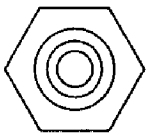
Figures 1, 9L:
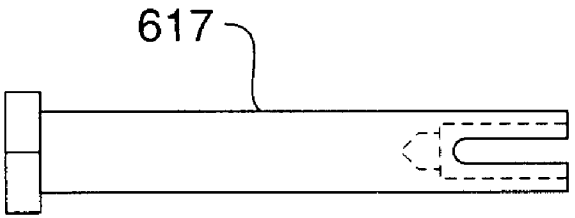
Figure 9M:
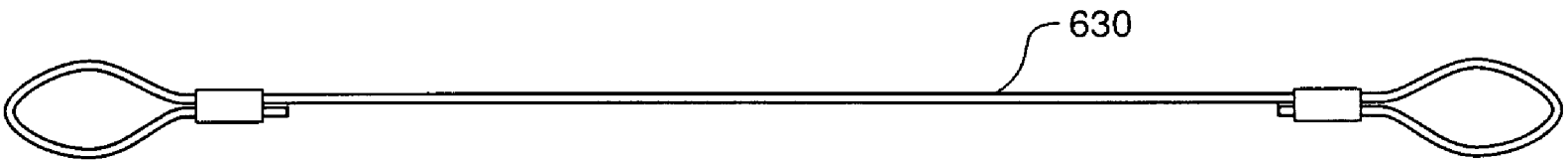
Figures 1, 9N:
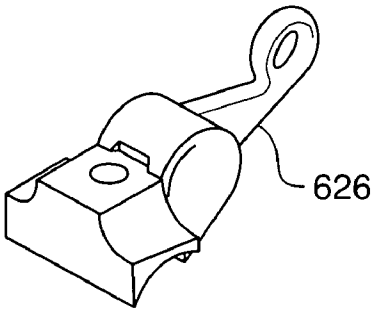
Figures 2, 9N:
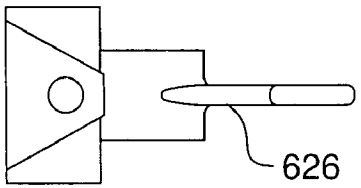
Figures 3, 9N:
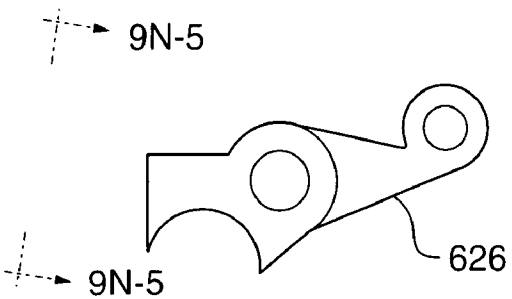
Figures 4, 9N:
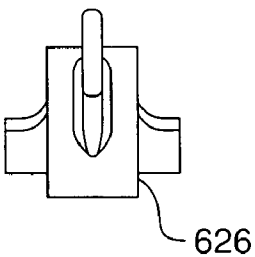
Figures 5, 9N:
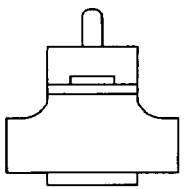

Linkage member 630 preferably includes a first securement 716 connected with moment arm connector 616. In one embodiment, linkage member 630 also includes a second securement 717 connected with drive link 620 (e.g., FIGS. 6A, 6C, 7G-7I). In one embodiment, first securement 716 and second securement 717 are any type of securement including without limitation, a clamp, a screw, a friction securement, a wrapped securement and any combination thereof. In one embodiment, moment arm connector 616 includes a clamp bolt and/or a pinch bolt 617 (FIG. 9L-1 to 9L-2). In one embodiment, (e.g., as illustrated in FIG. 6A) linkage member 630 is bent around guide 430.

In one embodiment, guide 430 (e.g., FIGS. 1E, 4A-1 to 4A-5, 4B, 5, 6A, 6C, 7A-7B) is any element that is configured to permit a desired length of travel when actuator 160 is depressed. For example, guide 430 in one embodiment is a U-bracket. In another embodiment, illustrated in FIGS. 6C, 7F-7I, guide 430 includes two posts 692 spaced apart a desired distance (e.g., a distance similar to that of the U-bolt legs). In one embodiment, guide 430 further enables linkage member 630 to change direction, for example by 90 degrees. In one embodiment, low friction element 693 (e.g., one or more pulleys, bushings, bearings) are employed to minimize friction at guide 430.

Preferably, linkage member 630 is configured such that when rocker arm 610 is caused to pivot, linkage member 630 travels back and forth from one side of guide 430 to the other (e.g., FIG. 6A). Linkage member 630 preferably includes a securement with drive link 620. In one embodiment, the securement with drive link 620 is at the axle portion of drive link 620. In one embodiment, that securement includes any securement including without limitation a clamp, a screw, a friction securement, a wrapped securement and any combination thereof. Preferably the securement with drive link 620 is substantially centered about linkage member 630. In one embodiment, the securement of linkage member 630 with drive link 620 is a wrap-around securement including two or three wraps. In one embodiment, the diameter of drive link 620 is configured to achieve a predetermined drive ratio. In one embodiment, the predetermined drive ratio of drive link 620 is achieved by selecting the diameter of drive link 620 or by including a collar around drive link 620 that effectively achieves the desired drive ratio. Drive link 620 preferable has axle portion 622 and elbow arm 624 (FIG. 6A). Linkage member 630 is preferably wrapped around axle portion 622 as illustrated in FIG. 6A. In a preferred embodiment, linkage member 630 includes a cable 631. In one embodiment, linkage member 630 is a solid link (e.g., stamped sheet metal). In one embodiment, linkage member 630 is capable of transmitting force in both tension and compression. In one embodiment, linkage member 630 includes two or more cables secured to one another by bias element 632 (e.g., a spring). In one embodiment, linkage member 630 is self tensioning. In one embodiment, as an effective length of linkage member 630 changes, bias element 632 is configured to maintain tension in linkage member 630. In another embodiment, linkage member 630 has no bias element. In one embodiment, bias elements supply compliance if, for example, second surface 320 is blocked during application of force to actuator 160. Thus, bias element 632 preferably extends rather than breaking actuator assembly 600. In a preferred embodiment, as linkage member 630 is pulled, for example, from across guide 430, axle portion 622 rotates and elbow arm 624 rotates axially about axle portion 622. In an embodiment of FIG. 6A, elbow arm 624 is rotatable within leg 640 at elbow hinge 642 and second surface 320 (e.g., FIGS. 7A-7E) is secured to leg 640 at door hinge 644.

In one embodiment, one or more pivot clamps 626 (e.g., FIG. 4B, 6A, 6C, 7A-7E, 9N-1 to 9N-5) secures drive link 620 to base 400 (e.g., as illustrated in FIG. 6A, 6C, 7A-7E). In one embodiment, pivot clamp 626 also is secured to second surface 320 via second surface bias members 628 (e.g., FIG. 6A, 6C, 7A-7E). In one embodiment, second surface bias members 628 are springs. In one embodiment, second surface bias members 628 are employed to provide a bi-stable configuration of actuator assembly 600. In embodiment, when platform 300 is in its retracted position, the distal end 322 (e.g., FIGS. 5, 7A-7I) of second surface 320 is urged toward frame 400.

In one embodiment, illustrated in FIGS., 7F-7I, pivot clamp 626 is not secured to second surface via second surface bias members. In one embodiment, bias clip 685 (e.g., FIG. 6D-1 to 6D-5, 7F-7I) is disposed around guide 430 (preferably posts 692) such that as linkage member 630 moves between positions associate with a toggling of rocker arm 610, bias clip 685 engages moment arm connector 616. In one embodiment, bias clip 685 biases moment arm connector 616 such that second surface 320 is urged toward frame 400 in a retracted or closed position. FIGS. 7F and 7G illustrate bias clip 685 engaged with moment arm connector 616 when second surface 320 is in a retracted (or closed) position. In the closed position, moment arm connector 616 is urged into a position against bias clip 685 at bend 687. By urging moment arm connector 616 into position against bend 687, second surface 320 is biased in a closed position. In one embodiment, upon operation of actuator 160, moment arm connector 616 is urged into a position away from bend 687 that corresponds to an extension of platform 300 (e.g., an opening of the door, where second surface 320 is co-planar with first surface 310 (e.g., FIGS. 7H-7I). In one embodiment, bend 687 has the added effect of causing second surface 320 to snap into and out of a closed position. In one embodiment, bias clip 685 renders second surface bias members 628 unnecessary.

Figure 7A:
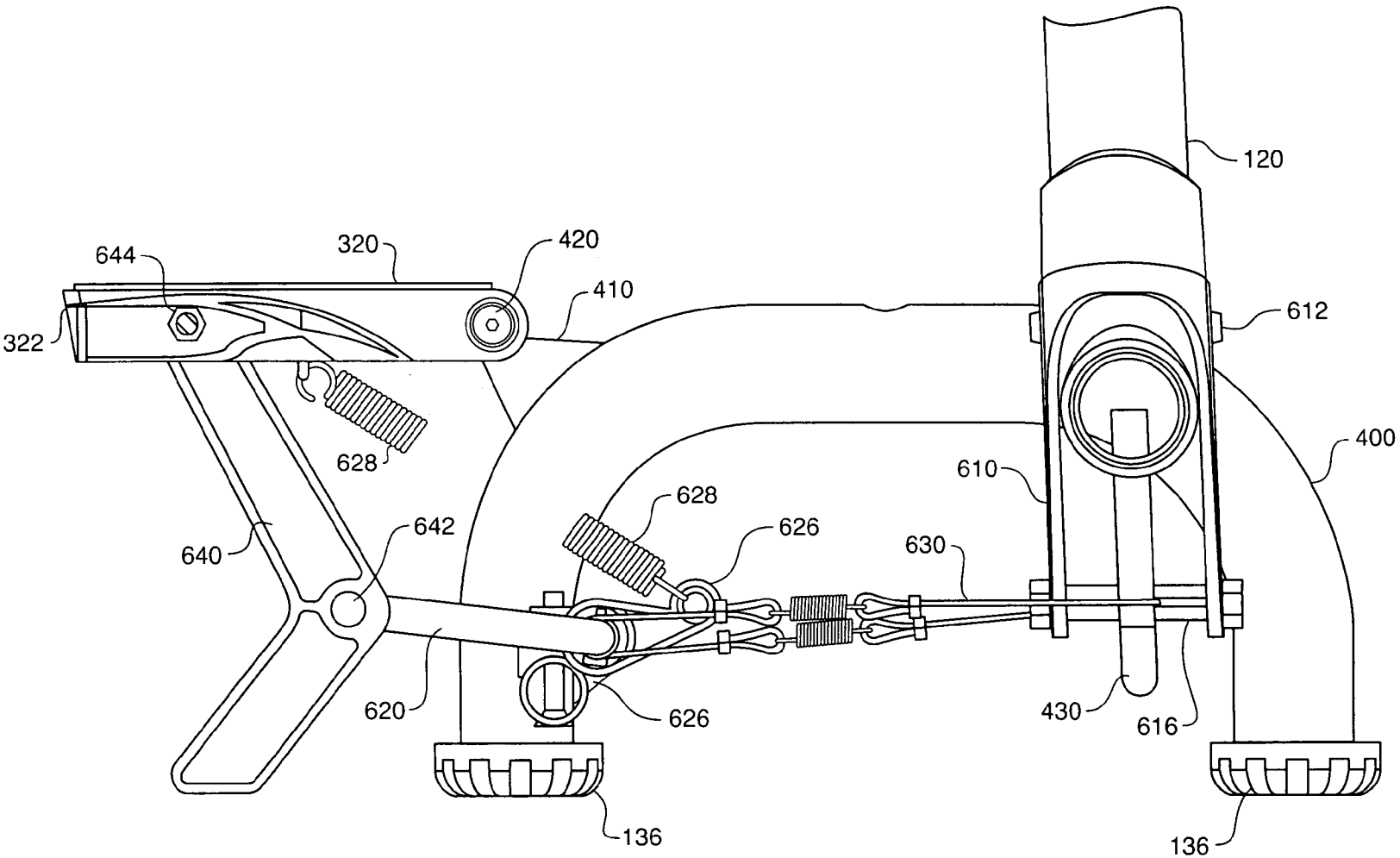
FIGS. 7A-7E illustrate cutaway views of a partially assembled actuator at various positions during extension of a platform according to the present invention.
Figure 7B:
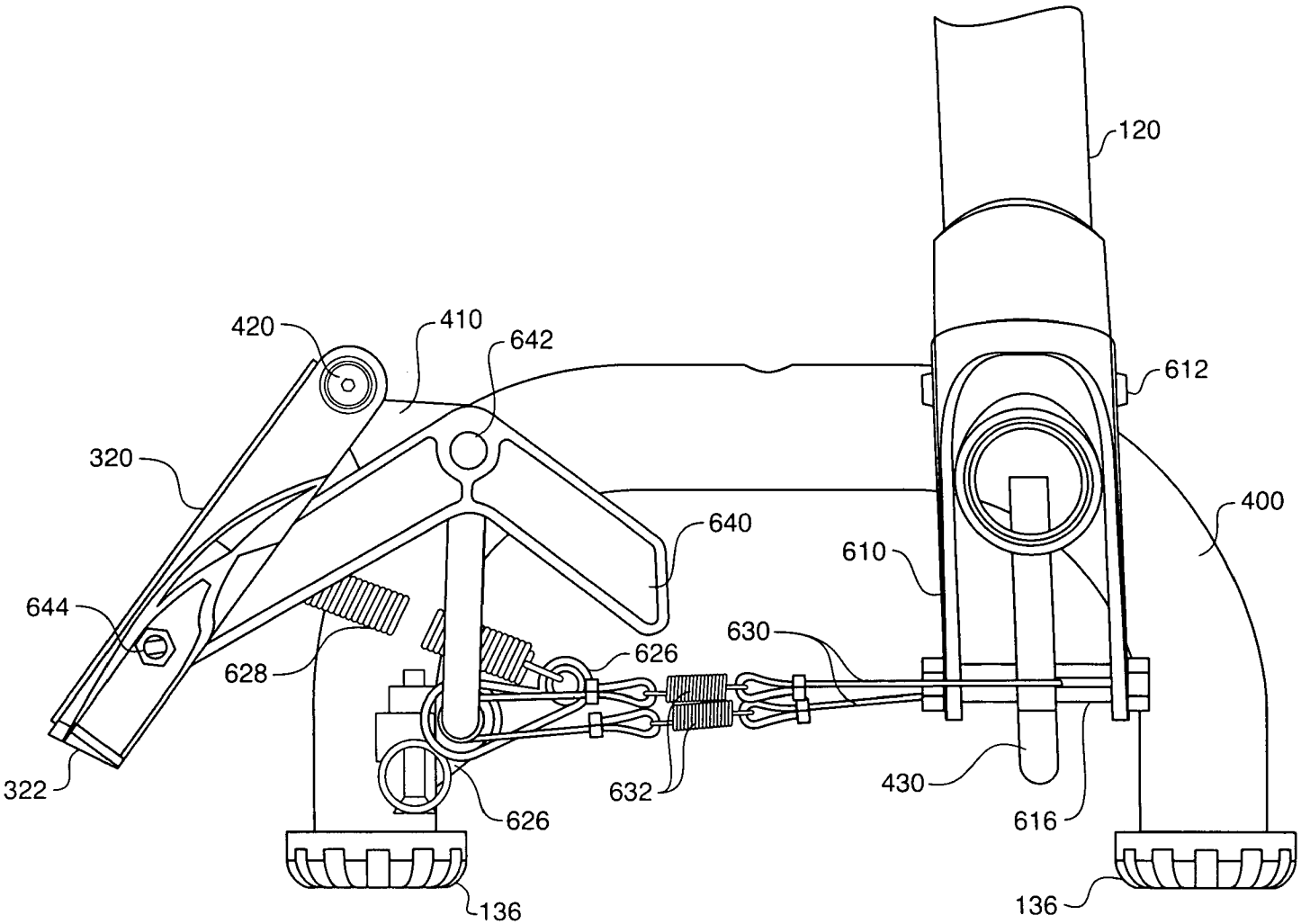
Figure 7C:
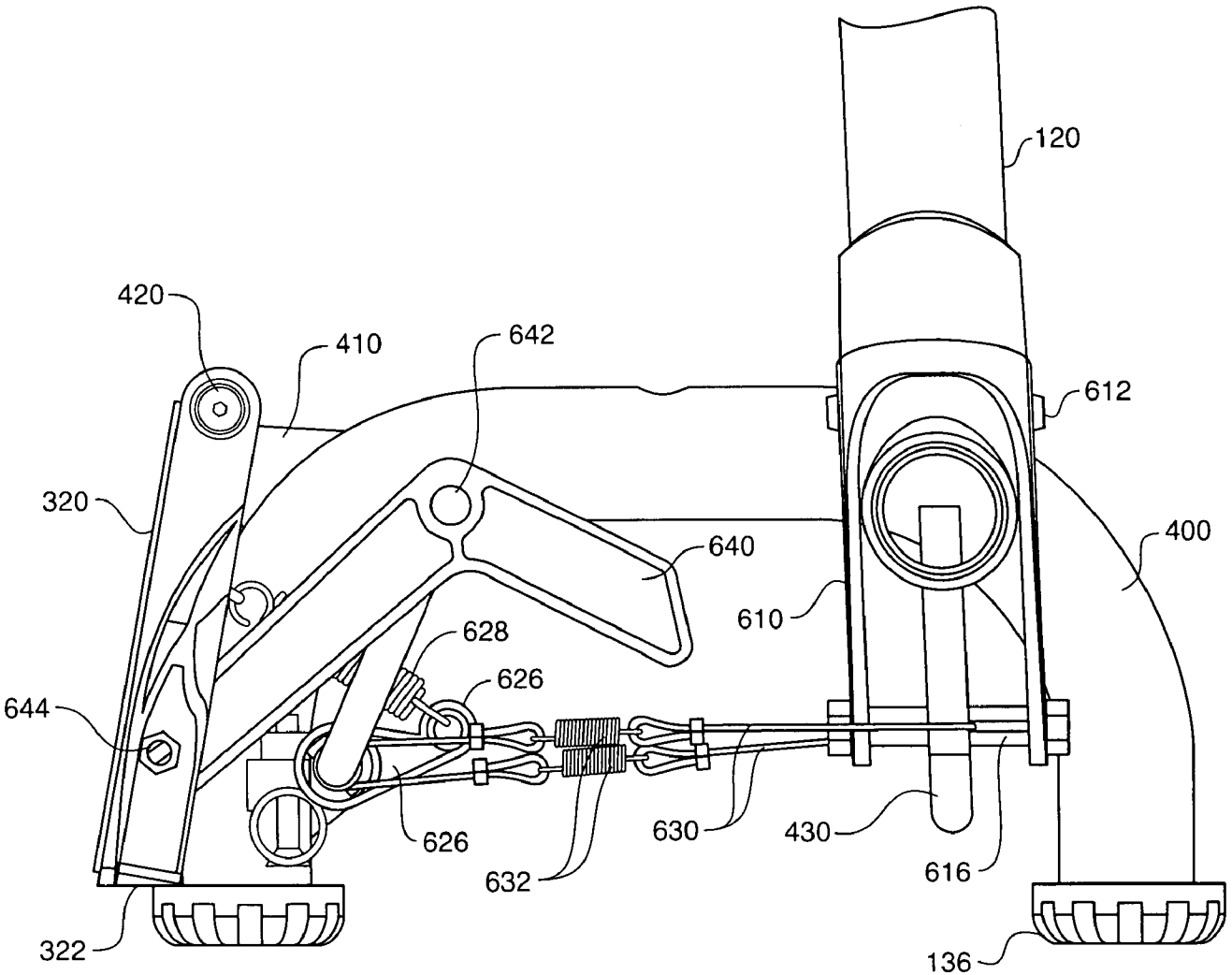
Figure 7D:
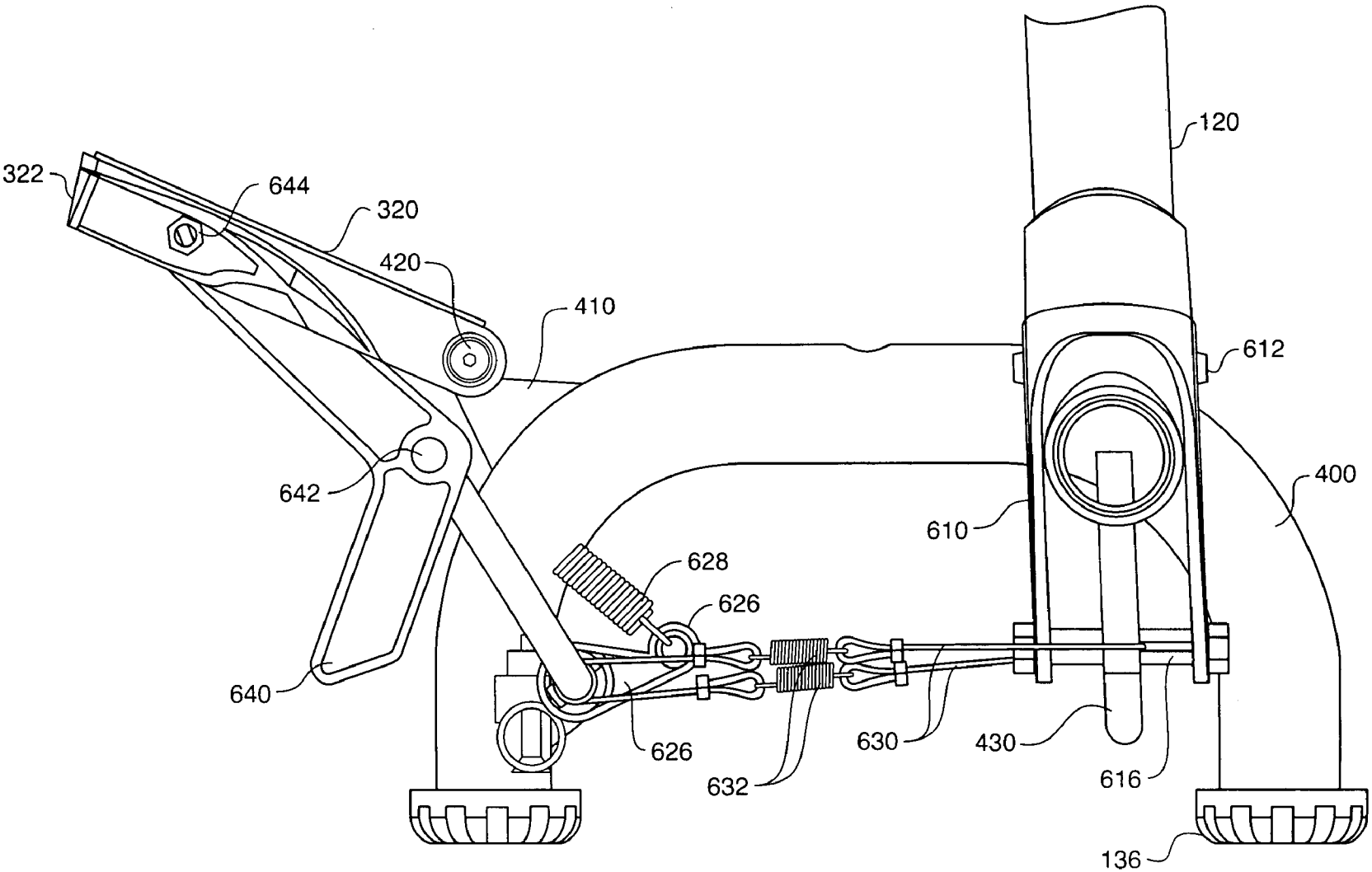
Figure 7E:
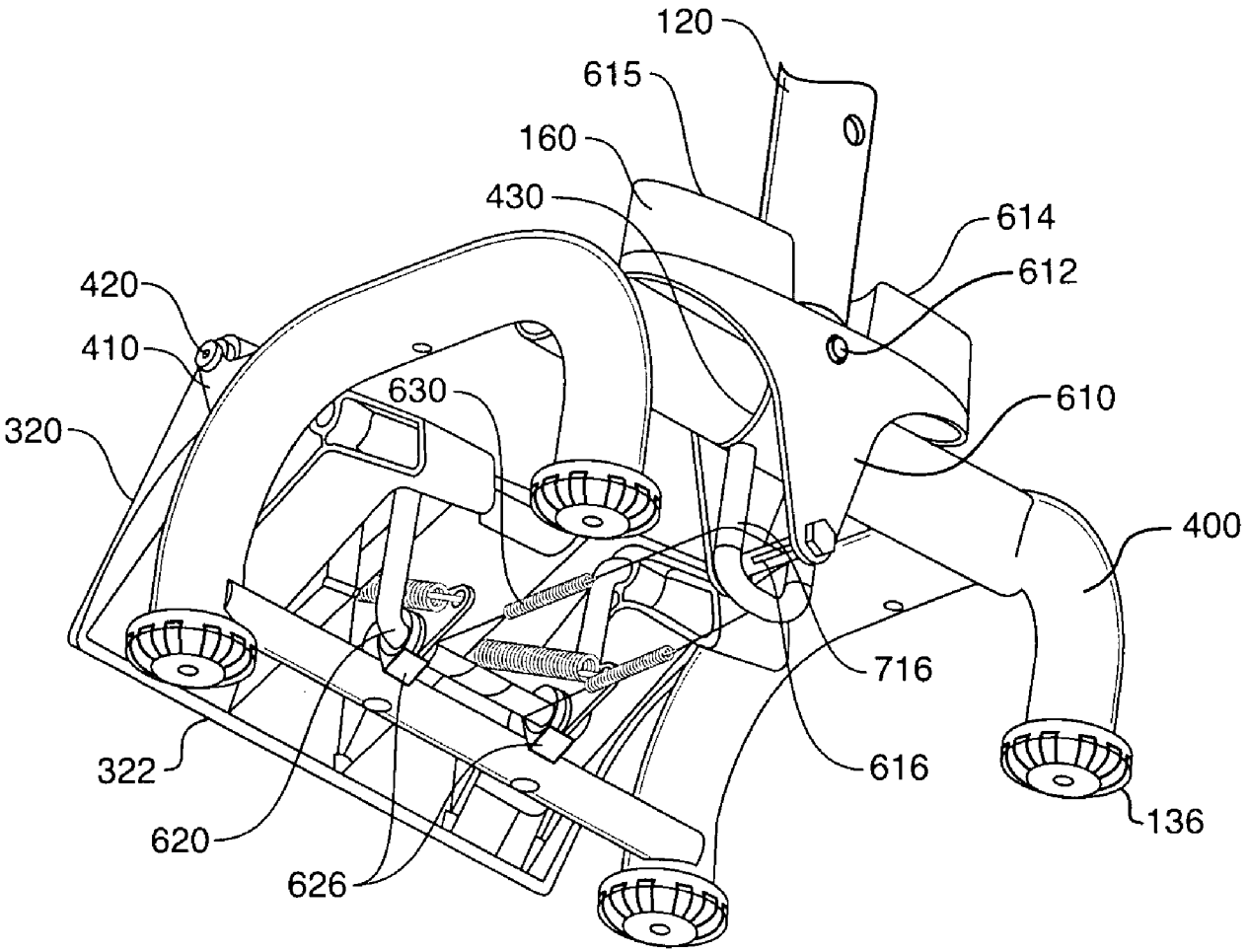
Figure 7F:
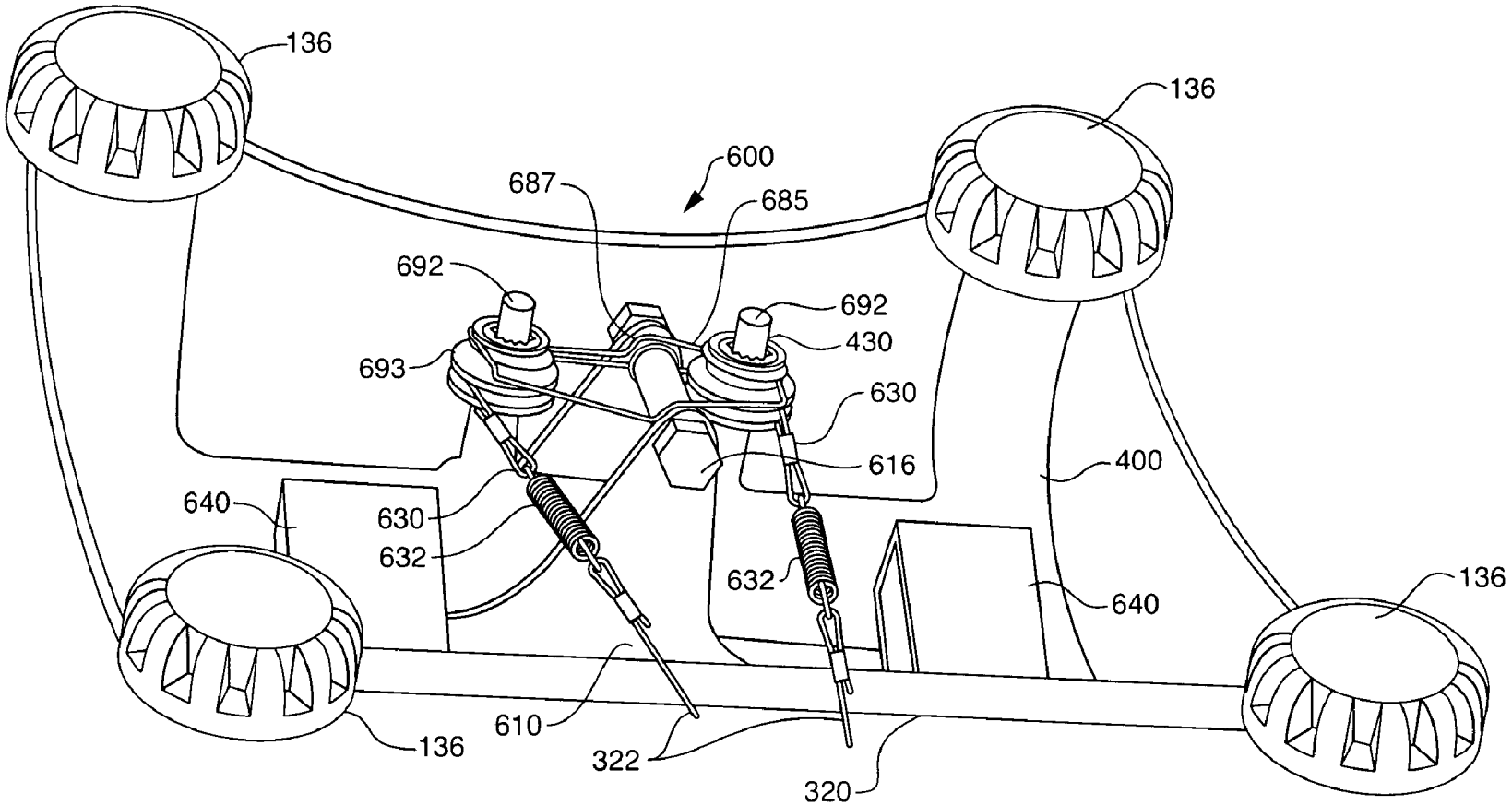
FIGS. 7F-7G illustrate one embodiment of portions of the actuator assembly in a retracted position according to the present invention.
Figure 7G:
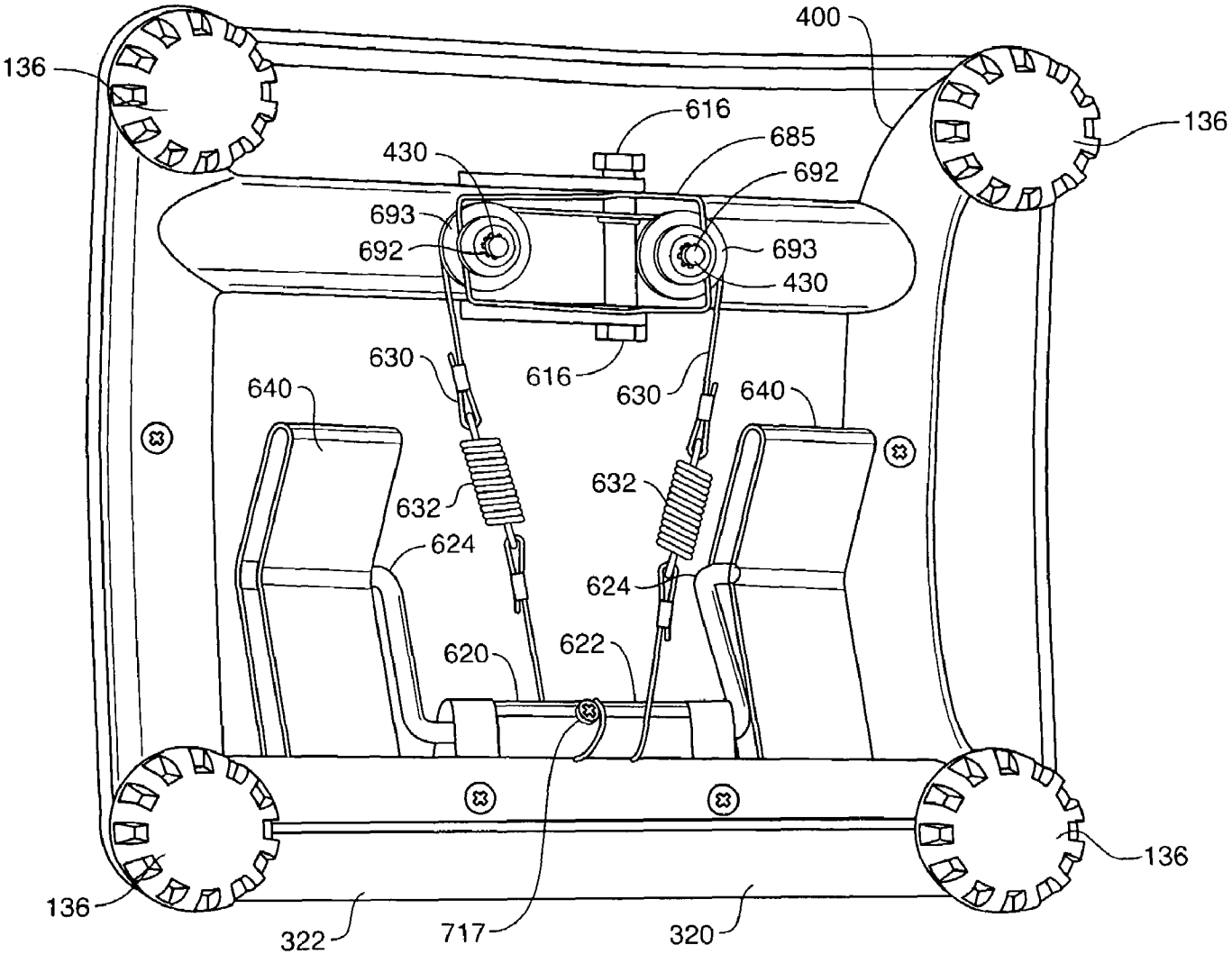
Figure 7H:
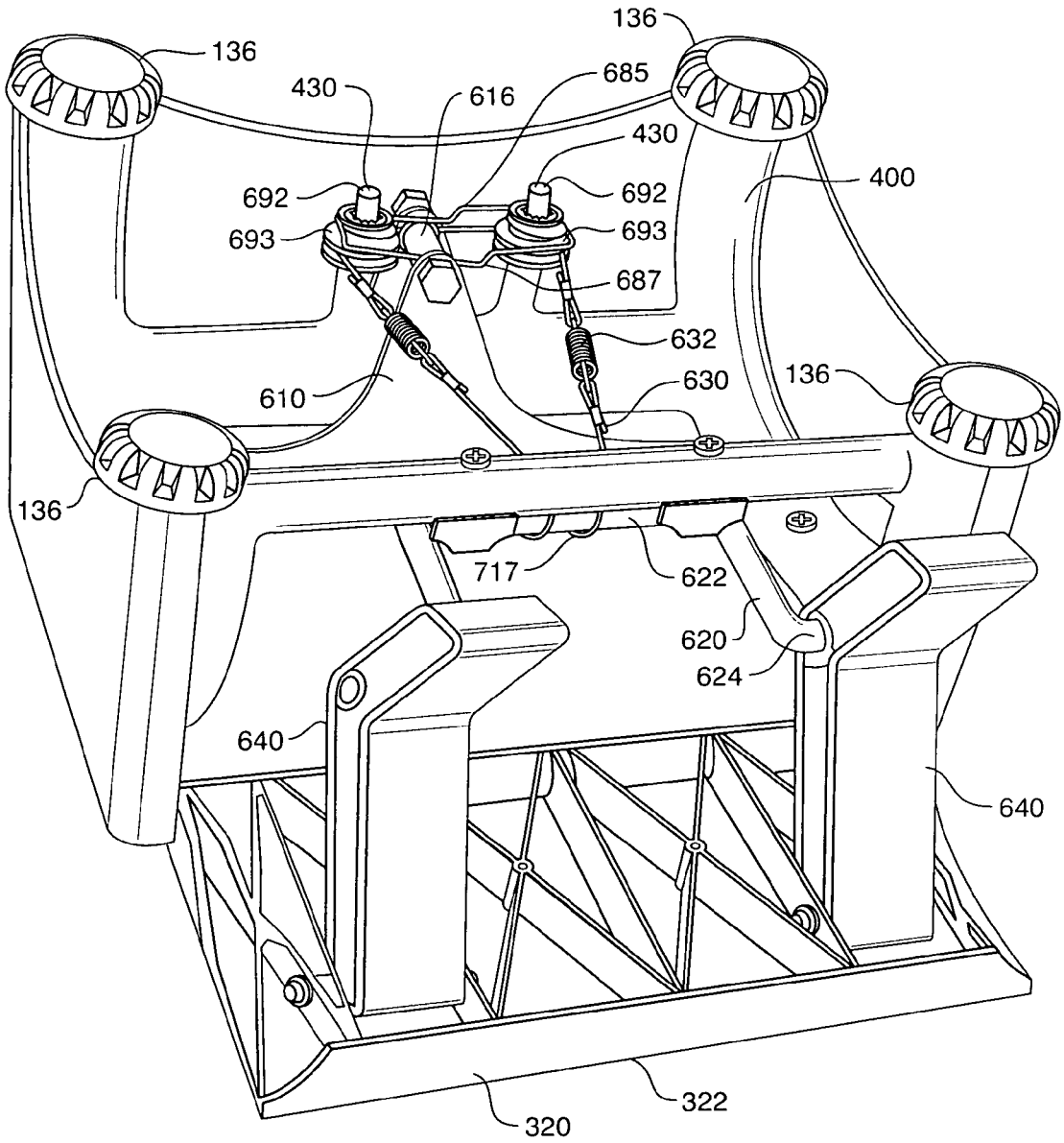
FIGS. 7H-7I illustrate one embodiment of portions of the actuator assembly in an extended position according to the present invention.
Figure 7I:
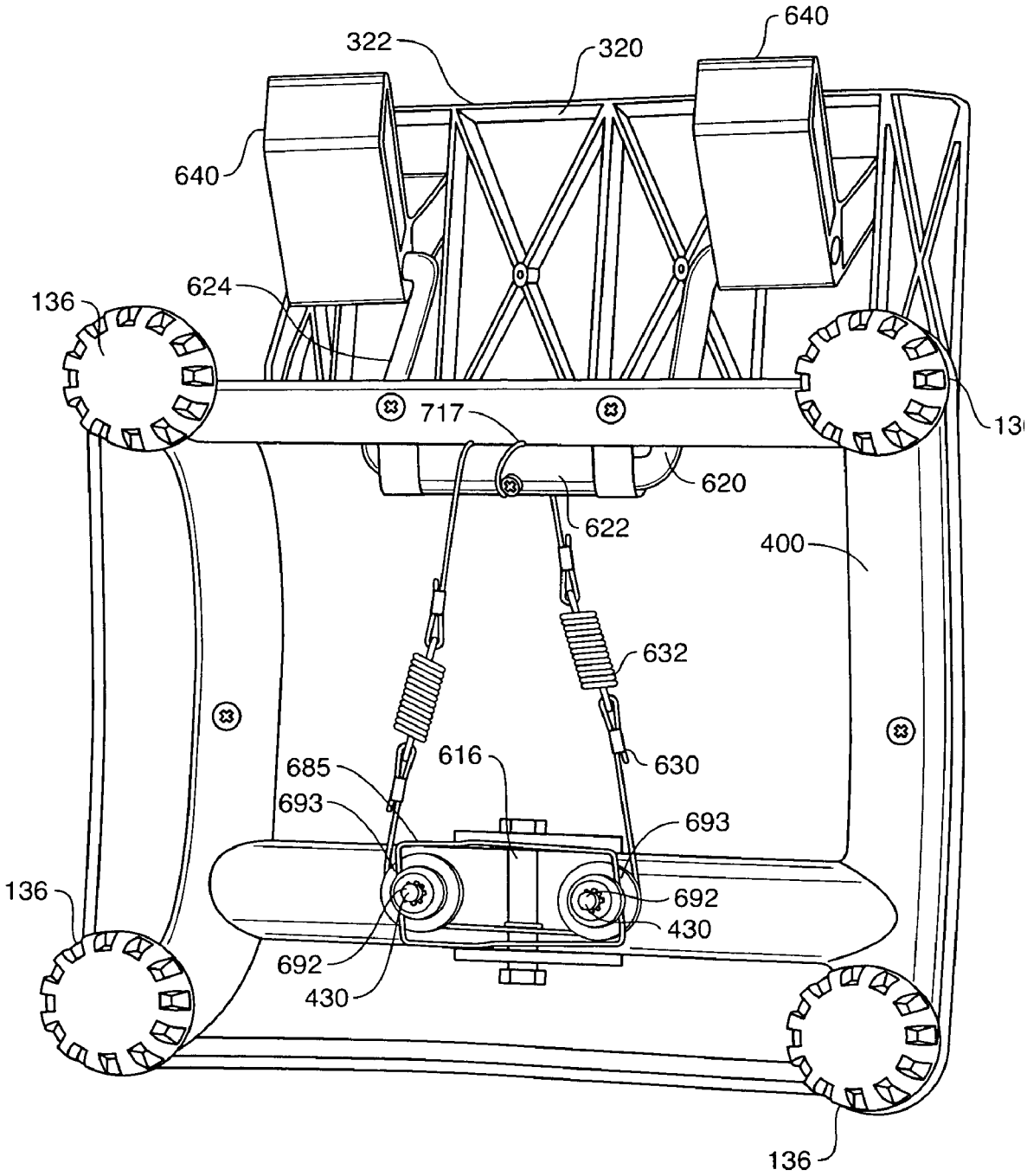

In a preferred operation of actuator 160, depression of first face 614 of actuator 160 causes linkage member 630 to pull, which causes drive link 620 to rotate and elbow arm 624 to push legs 640 to rotate second surface 320 (shown in FIG. 7A). Second surface 320 then preferably rotates about pivot rod 420 thus extending platform 300. Legs 640 are shaped such that second surface 320 is supported by one or more legs 640 when platform 300 is extended and tread 646 engages the datum surface 50 (e.g., a floor, ground, stair or other surface as illustrated in FIG. 1B). Conversely, when second face 615 of rocker arm is engaged, legs 640 are retracted and second surface 320 returns to its retracted position and urged toward frame 400.

In one embodiment, there is preferably a step-up device with an extendable platform that retracts by operation of an actuator assembly within a housing, a portion of which forms the platform. In one embodiment, step-up device 100 includes one or more legs 640 having an L-shaped configuration illustrated in FIG. 9K-1 to 9K-3. In one embodiment, legs 640 have an upper end 648 and a lower end 649. In one embodiment, upper end 648 has a longitudinal axis 641 and lower end 649 has a longitudinal axis 646. In one embodiment, one or more legs 640 have an angle $\alpha$ between upper end longitudinal axis 641 and a vertical line of between 0° and 50°. In one embodiment, one or more legs 640 have an angle $\alpha$between upper end longitudinal axis 641 and a vertical line of between 20° and 30°. In one embodiment, angle $\alpha$ is approximately 25°. In one embodiment, one or more legs 640 have an angle $\beta$ between lower end longitudinal axis 643 and datum surface 50 of between 30° and 90°. In one embodiment, one or more legs 640 have an angle $\beta$ between lower end longitudinal axis 643 and datum surface 50 of between 40° and 60°. In one embodiment angle $\beta$ is approximately 50°.

In one embodiment, upright 120 (e.g., FIGS. 1A-1F, 2, 3A, 3B, 4A-1 to 4A-5, 5, 6A, 6C, 7A-7E, 8A-8C) is secured to base 130 by any means (e.g., glued, welded, bolted). In one embodiment, frame 400 and upright 120 are a uni-frame construction. In one embodiment, upright 120 is any shape. In one embodiment, illustrated for example in FIGS. 1E, 3B, 8A, 9A, 9C-1 to 9C-2, upright 120 is a "modified-gooseneck" shape including a vertical shaft 122 and a "c-shaped" shaft 124 as illustrated. In one embodiment, c-shaped shaft 124 includes lateral 126 (FIG. 1E). In one embodiment, lateral 126 is substantially horizontal to datum surface 50. In one embodiment, lateral 126 is contiguous with upright 120 and c-shaped shaft 124. In one embodiment, upright 120 is configured to permit an accessory fixture 140 to extend laterally beyond upright 120 such that step-up device 100 can be hung from accessory fixture 140 (e.g., from a shopping cart). In one embodiment, accessory fixture 140 is attached to upright 120, preferably proximate to upper handle 110*a*. (e.g., FIG. 1A, 9B-1 to 9B-8, 9O-1 to 9O-4) In one embodiment, accessory fixture 140 is configured to enable a user to hang step-up device 100 by accessory fixture 140 (e.g., on a shopping cart). Accessory fixture 140 preferably is also configured to accept an accessory that hangs from accessory fixture 140. (e.g., a handbag—not shown). In one embodiment, accessory FIG. 140 has upward extending stem 925. In one embodiment, accessory fixture 140 has downward extending stem 926. In one embodiment, accessory fixture 140 has both an upward extending stem 925 and a downward extending stem 926 (e.g., FIG. 9B-1 to 9B-8). In one embodiment, accessory fixture 140 has a downward extending stem 926 and no upward extending stem (FIG. 9O-1 to 9O-4).

Preferably, vertical shaft 122 is contiguous with c-shaped shaft 124. In one embodiment, "s-shaped" shaft 127 is disposed between c-shaped shaft 124 and vertical shaft 122. (FIG. 8A). In a preferred embodiment, upright 120 has a round cross section. In one embodiment, step-up device 100 has a plurality of uprights 120.

In one embodiment, upright 120 has any length selected by those of ordinary skill in the art. In one embodiment, one or more uprights 120 include a fixed length. In a preferred embodiment, upright 120 preferably includes an adjustable length. Preferably, upright 120 has a lower upright 122*b* and upper upright 122*a*. In one embodiment, lower upright 122*b* and upper upright 122*a* are tubular members of either the same or different diameters. In a preferred embodiment, upper upright 122*a* has a smaller diameter than lower upright 122*b*. Preferably, upper upright 122*a* fits within lower upright 122*b*. In one embodiment, the height of upright 120 is adjusted by changing the position of upper upright 122*a* with respect to lower upright 122*b*. Preferably, upright 120 is locked to a desired height by matching a spring pin 125*a* with a desired notch 125*b*. In one embodiment, pin 125*a* and notch 125*b* are on either one of lower upright 122*b* or upper upright 122*a*. In one embodiment, upright 120 includes an anti-rattle element as described in U.S. patent application entitled Rolling/Braking Cane filed on even date herewith and incorporated by reference in its entirety herein. Anti-rattle element preferably includes a collet nut and split ring. In a preferred embodiment, the collet nut is tightened to secure upright 120. In a preferred embodiment, the split ring is interposed between collet nut and a lower upright 122*b*. Preferably the collet nut includes an interior beveled edge and lower upright 122*b* has an opposing beveled edge. Thus, as the collet nut is tightened, the diameter of the split ring preferably is reduced and is wedged between the opposing beveled edges of the collet nut and lower upright 122*b*. In one embodiment, upright 120 is oriented perpendicular to base 130 and preferably is fixed to base 130. In one embodiment, upright 120 includes metal clip 905 and radial spring 907. In one embodiment, metal clip 905 and/or radial spring 907 (e.g., FIG. 9A) are configured to apply a radial force outwardly and center lower upright 122*b* relative to upper upright 122*a*.

Step-up device 100 may have any number of handles 110. Preferably step-up device 100 has upper handle 110*a* and at least one lower handle 110*b* (e.g., FIG. 1A, 8A). In one embodiment, one or more lower handles 110*b* are configured to assist a user to stand from a sitting position. In one embodiment, lower handle 110*b* includes a stiffening member 195 (FIG. 1A) inserted within lower handle 110*b*. In one embodiment, stiffening member 195 is welded to upright 120. In one embodiment, stiffening member 195 is an aluminum tube. In one embodiment, one or more handles 110 have centerpoints that are substantially aligned. Handles 110 preferably are ergonomically configured such that a person using step-up device 100 naturally places their hand on handle 110*a* or 110*b* at a point substantially corresponding (e.g., substantially aligned) to the centerpoint of upright 120. (e.g., FIG. 1B, 8A). In one embodiment, handles 110 are contoured to include bulge 204 that is bounded by necks 202. In a preferred embodiment, handles 110*a* and 110*b* are contoured such that the natural placement of a user's hand on the handle would apply a force in substantially the same direction relative to upright 120 irrespective of the direction that user grabbed handle 110. For example, as described herein, a user might position platform 300 relative to upright 120 in one manner while walking and in another manner while climbing stairs. In both positions, the force applied to handles 110*a* and 110*b* preferably are substantially in the same direction relative to upright 120. In one embodiment, bulge 204 is substantially aligned with upright 120. In a preferred embodiment, bulge 204 is substantially aligned with the approximate center of gravity of step-up device 100. In a preferred embodiment, handles 110 are substantially symmetric. In one embodiment, handles 110 are symmetric about bulge 204. In a preferred embodiment, handles 110 include tip 205 (e.g., FIG. 2). In one embodiment, tip 205 is tilted slightly upward with respect to lateral 126 and/or datum surface 50 (a floor, ground, stair or other surface illustrated in FIG. 1B). In one embodiment, the slight upward tilt of tip 205 is configured to be useful for assisting a user to rise, for example, to a standing position from a sitting position. In one embodiment, handles 110 include an outer grip having cut-out portions 295 (e.g., FIG. 2) and are configured to enhance a user's grip on the handle 100.

In a preferred embodiment, illustrated in FIG. 2, handles 110*a* and 110*b* are positioned a distance $d_h$ of between approximately 6 inches and approximately 10 inches and more preferably approximately 7½ inches and even more preferably approximately 7⅖ inches. In one embodiment (not illustrated), the vertical distance between handle 110*a* and handle 110*b* is adjustable. In one embodiment, handle 110*a* and 110*b* are substantially horizontal. In alternate embodiments, handles 110*a* and 110*b* may be oriented at any angle with respect to upright 120. In one embodiment, one or both of handles 110*a* and 110*b* are tilted slightly downward (e.g., in a direction away from upright 120).

The embodiments of the present invention described above may be independently incorporated in the step-up device of the present invention. Alternatively, any two or more of the embodiments described (including those described in documents incorporated by reference herein) can be combined into a single step-up device of the present invention. Although the foregoing description is directed to preferred embodiments of the invention, it is noted that other variations and modifications in the details, materials, steps and arrangement of parts, which have been herein described and illustrated in order to explain the nature of the preferred embodiment of the invention and may be made without departing from the spirit or scope of the invention. Any dimensions referenced herein are exemplary dimensions of certain embodiments of the invention.

The invention claimed is:

1. A step-up assist device comprising:

a base having an extendable and retractable platform;

an actuator assembly with an actuator operably engaged with linkage connected to the platform, the linkage configured to extend and retract the platform upon operation of the actuator;

wherein the actuator assembly includes a rocker arm having a first face, a second face, a pivot point between the first face and second face and a moment arm connector extended a fixed distance from the pivot point;

a drive link with an axle portion and an elbow arm radially disposed about the axle portion; and a linkage member having a substantially constant tension and a first securement engaged with the moment arm connector and a second securement engaged to the axle portion of the drive link wherein a pivot of the moment arm connector about the pivot point induces the axle portion to rotate and the elbow arm to rotate about the axle arm.

2. The step-up device of claim 1 further comprising an upright connected substantially normal to the base.

3. The step-up device of claim 2 wherein the actuator is connected to the base proximate a connection from the upright to the base.

4. The step-up device of claim 1 wherein the platform has a first planar surface and a movable second planar surface that pivots between substantially coplanar with the first planar surface to substantially perpendicular to the first planar horizontal surface.

5. The step-up assist device of claim 4 wherein the actuator has a first position corresponding to an extended configuration of the platform and a second position corresponding to a retracted position of the platform and wherein the first position of the actuator corresponds to the second planar surface being substantially coplanar with the first planar surface and the second position of the actuator corresponds to the second planar surface being substantially perpendicular to the first planar surface.

6. The step-up device of claim 5 further comprising at least one leg linked to both the actuator and the extendible platform wherein the at least one leg supports at least a portion of the platform in an extended position.

7. The step-up device of claim 6 wherein the at least one leg is rotatably connected to the elbow arm and to the second planar surface and wherein the rotation of the elbow arm induces the second planar surface to pivot to a substantially locked position and the leg to support the second planar surface.

8. The step-up device of claim 5 wherein the platform is configured to allow a user to stand on the first planar surface when the step-up device is in the retracted position.

9. The step-up device of claim 1 wherein substantially all of the linkage is disposed within the base.

10. The step-up device of claim 1 wherein the linkage includes cable linkage.

11. The step-up device of claim 1 wherein the linkage includes rigid linkage.

12. The step-up device of claim 1 wherein the rigid linkage comprises stamped sheet metal.

13. The step-up device of claim 1 wherein the moment arm connector pivots about the pivot point during operation of the actuator.

14. The step-up device of claim 1 wherein the base is configured to be stepped upon when the base is in a retracted position and when the base is in an extended position.

15. The step-up device of claim 1 wherein the actuator includes a foot pedal.

16. The step-up device of claim 1 further comprising a shaft with a first end connected to the base and a second end configured to accommodate a user's hand wherein the actuator is configured to be operated by the user's hand.

17. The step-up device of claim 1 wherein the actuator and the linkage are configured to allow a depression of the first face to cause the platform to extend and to allow a depression of the second face to causes the platform to retract.

18. The step-up device of claim 1 wherein the base includes a housing and wherein the rocker arm extends through at least one aperture in the housing.

19. The step-up device of claim 1 wherein the actuator includes a double acting button.

* * * * *